US012808127B2

(12) United States Patent
Zhang

(10) Patent No.: US 12,808,127 B2
(45) Date of Patent: Nov. 24, 2026

(54) SYSTEM AND METHOD FOR MANUFACTURING A MULTI-LAYER COMPOSITE PULP TRAY

(71) Applicant: Paul Zhang, West Palm Beach, FL (US)

(72) Inventor: Paul Zhang, West Palm Beach, FL (US)

( * ) Notice: Subject to any disclaimer, the term of this patent is extended or adjusted under 35 U.S.C. 154(b) by 0 days.

(21) Appl. No.: 19/136,245

(22) PCT Filed: Mar. 7, 2025

(86) PCT No.: PCT/US2025/019048
§ 371 (c)(1),
(2) Date: Jun. 5, 2025

(87) PCT Pub. No.: WO2026/111759
PCT Pub. Date: May 28, 2026

(65) Prior Publication Data

US 2026/0146388 A1 May 28, 2026

Related U.S. Application Data

(60) Provisional application No. 63/724,889, filed on Nov. 25, 2024, provisional application No. 63/724,271, filed on Nov. 22, 2024.

(51) Int. Cl.
*D21J 5/00* (2006.01)
*B65D 1/36* (2006.01)

(52) U.S. Cl.
CPC . *D21J 5/00* (2013.01); *B65D 1/36* (2013.01)

(58) Field of Classification Search
CPC ..... D21J 5/00; D21J 3/00; D21J 7/00; B65D 1/36
See application file for complete search history.

(56) References Cited

U.S. PATENT DOCUMENTS 1,845,831 A * 2/1932 Chaplin ..... D21J 5/00 162/227
2,704,493 A * 3/1955 Randall ..... D21J 5/00 206/521.1

(Continued)

FOREIGN PATENT DOCUMENTS

CN 102995502 A 3/2013
CN 106996060 A * 8/2017 ..... D21J 3/00

(Continued)

*Primary Examiner* — Jose A Fortuna
(74) *Attorney, Agent, or Firm* — Lance M. Pritikin

(57) ABSTRACT

Exemplary embodiments of a system and method of manufacturing a multi-layer composite pulp tray incorporate a composite pulp forming machine, a drying line, and a drying and shaping machine. The composite pulp forming machine produces a wet formed multi-layer composite pulp tray using a first forming station, a second forming station, and a transfer mold subassembly. The first forming station includes a first layer forming mold and a second layer forming mold on opposing sides of a first spindle. The second forming station has a third layer forming mold and a fourth layer forming mold on opposing sides of a second spindle. The wet formed multi-layer composite pulp tray is converted to a semi-dry formed multi-layer composite pulp tray by conveyance through a drying line. The drying and shaping machine applies heat and pressure to the semi-dry formed multi-layer composite pulp tray, and outputs a resulting multi-layer composite pulp tray.

20 Claims, 27 Drawing Sheets

(56) References Cited

U.S. PATENT DOCUMENTS

| | | | | |
|---|---|---|---|---|
| 3,234,080 | A * | 2/1966 | Wells | D21J 7/00 162/219 |
| 3,320,120 | A | 5/1967 | Randall | |
| 3,757,704 | A | 9/1973 | Allgeyer et al. | |
| 4,221,751 | A | 9/1980 | Haataja et al. | |
| 4,790,966 | A | 12/1988 | Sandberg et al. | |
| 5,246,772 | A | 9/1993 | Manning | |
| 5,435,954 | A | 7/1995 | Wold | |
| 5,769,001 | A | 6/1998 | Viessmann | |
| 5,934,202 | A | 8/1999 | Lai | |
| 5,964,162 | A | 10/1999 | Chuan-Jen | |
| 9,663,898 | B2 | 5/2017 | Zhang | |
| 12,138,830 | B2 * | 11/2024 | Larsson | B27N 3/203 |
| 12,221,248 | B2 | 2/2025 | Zhang | |
| 12,297,603 | B2 * | 5/2025 | Zheng | D21J 5/00 |
| 2004/0013830 | A1 | 1/2004 | Nonomura et al. | |
| 2004/0043168 | A1 | 3/2004 | Ishikawa et al. | |
| 2004/0137196 | A1 | 7/2004 | Wang | |
| 2015/0041081 | A1 | 2/2015 | Banu et al. | |
| 2015/0292154 | A1 * | 10/2015 | Zheng | D21F 7/006 162/253 |
| 2016/0368659 | A1 | 12/2016 | Bastian, II et al. | |
| 2017/0073902 | A1 | 3/2017 | Pal et al. | |
| 2017/0081075 | A1 | 3/2017 | Bruce et al. | |
| 2026/0146388 | A1 * | 5/2026 | Zhang | D21J 5/00 |

FOREIGN PATENT DOCUMENTS

| | | | | |
|---|---|---|---|---|
| CN | 108058446 | A * | 5/2018 | B32B 37/12 |
| CN | 115323832 | A * | 11/2022 | D21J 5/00 |
| CN | 115341402 | A * | 11/2022 | D21J 5/00 |
| CN | 115627662 | A * | 1/2023 | D21J 5/00 |
| CN | 108252164 | B * | 8/2023 | D21J 5/00 |
| DE | 2007055 | A | 9/1971 | |
| EP | 0878405 | A1 | 11/1998 | |
| GB | 1157485 | A * | 7/1969 | D21J 5/00 |
| JP | 2001-58375 | A | 8/1999 | |
| WO | WO-2018229527 | A1 * | 12/2018 | D21J 7/00 |
| WO | 2024039387 | A1 | 2/2024 | |
| WO | WO-2026111759 | A1 * | 5/2026 | |

* cited by examiner

SYSTEM AND METHOD FOR MANUFACTURING A MULTI-LAYER COMPOSITE PULP TRAY

RELATED APPLICATIONS

This application is a U.S. national stage of PCT International Patent Application No. PCT/US2025/019048 having an international filing date of Mar. 7, 2025, which claims the benefit of U.S. Provisional Patent Application No. 63/724,271 filed Nov. 22, 2024, and U.S. Provisional Patent Application No. 63/724,889 filed Nov. 25, 2024. The contents of the above-identified applications are incorporated by this reference in their entireties for all purposes as if fully set forth herein.

TECHNICAL FIELD

The present disclosure relates to pulp molded products, and the systems and processes by which they are manufactured.

SUMMARY

Certain deficiencies of the prior art are overcome by the provision of a system and method for manufacturing a multi-layer composite pulp tray, and the resulting tray product, as disclosed herein.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
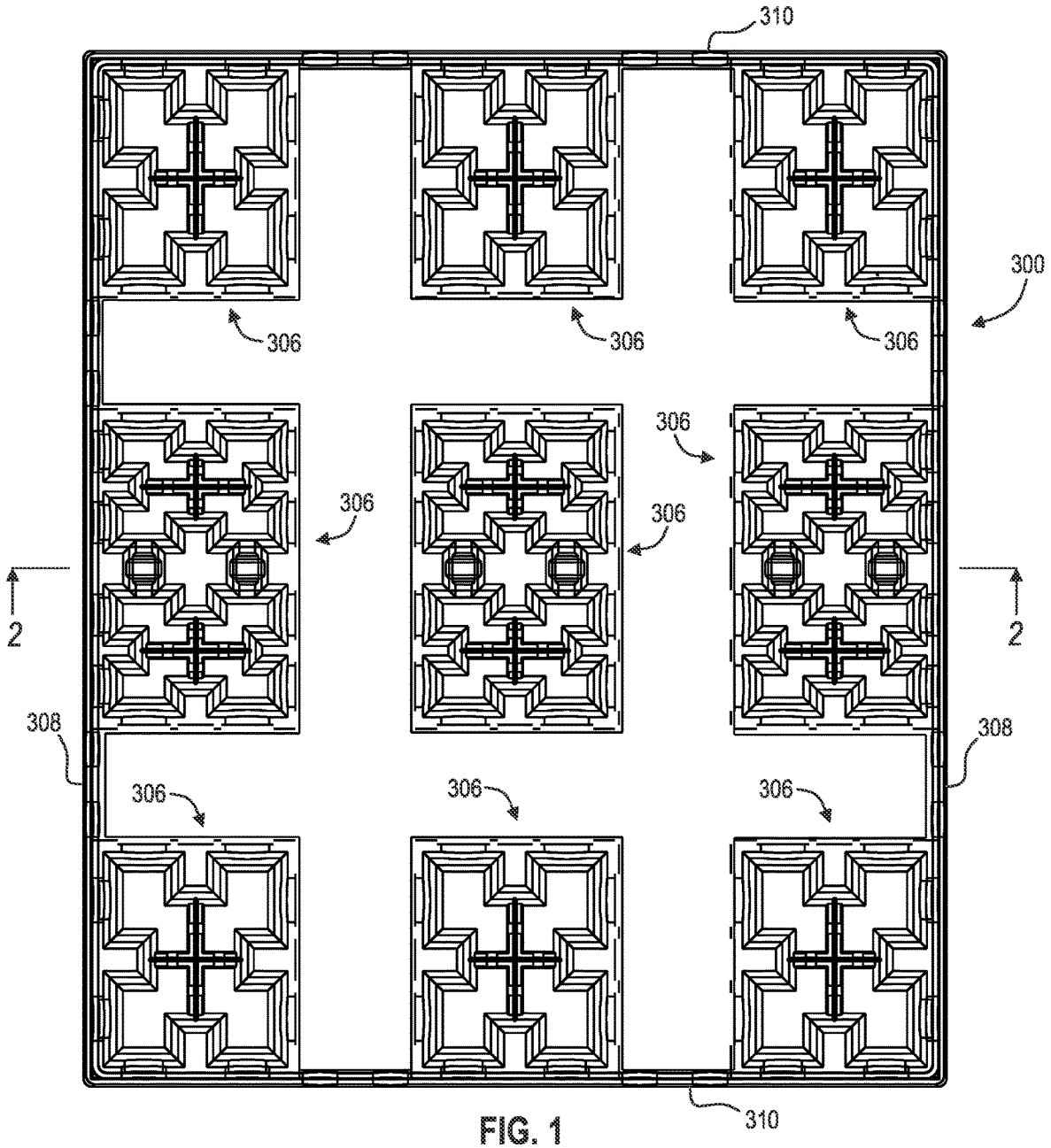
FIG. 1 is a diagrammatic bottom view of one non-limiting example of a multi-layer composite pulp tray manufactured in accordance with one non-limiting example of the system and method of the present disclosure.

Referring now to the drawings, like reference numerals designate identical or corresponding features throughout the several views.

Figure 4:
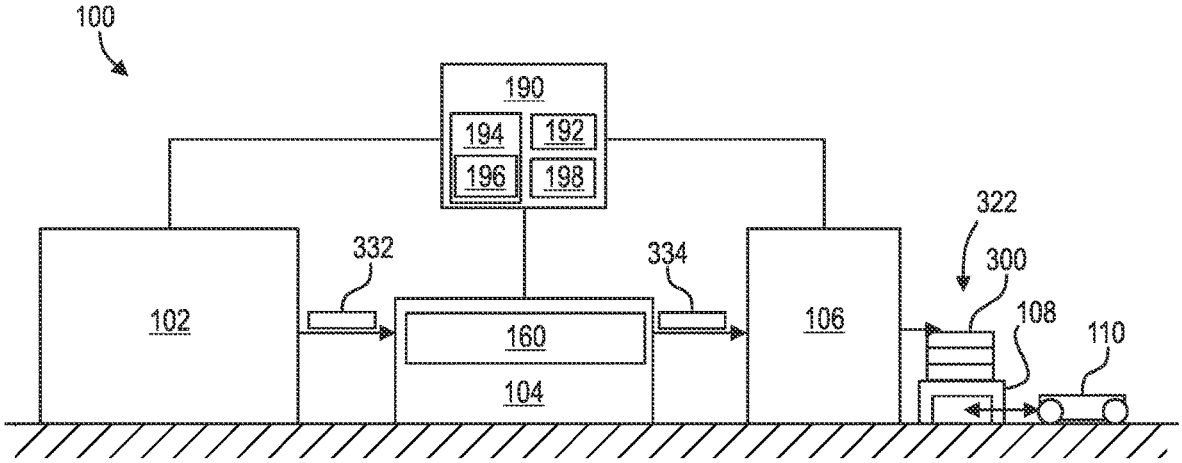
FIG. 4 is a diagrammatic view of one non-limiting example of a system for manufacturing a multi-layer composite pulp tray in accordance with the present disclosure.
Figure 26:
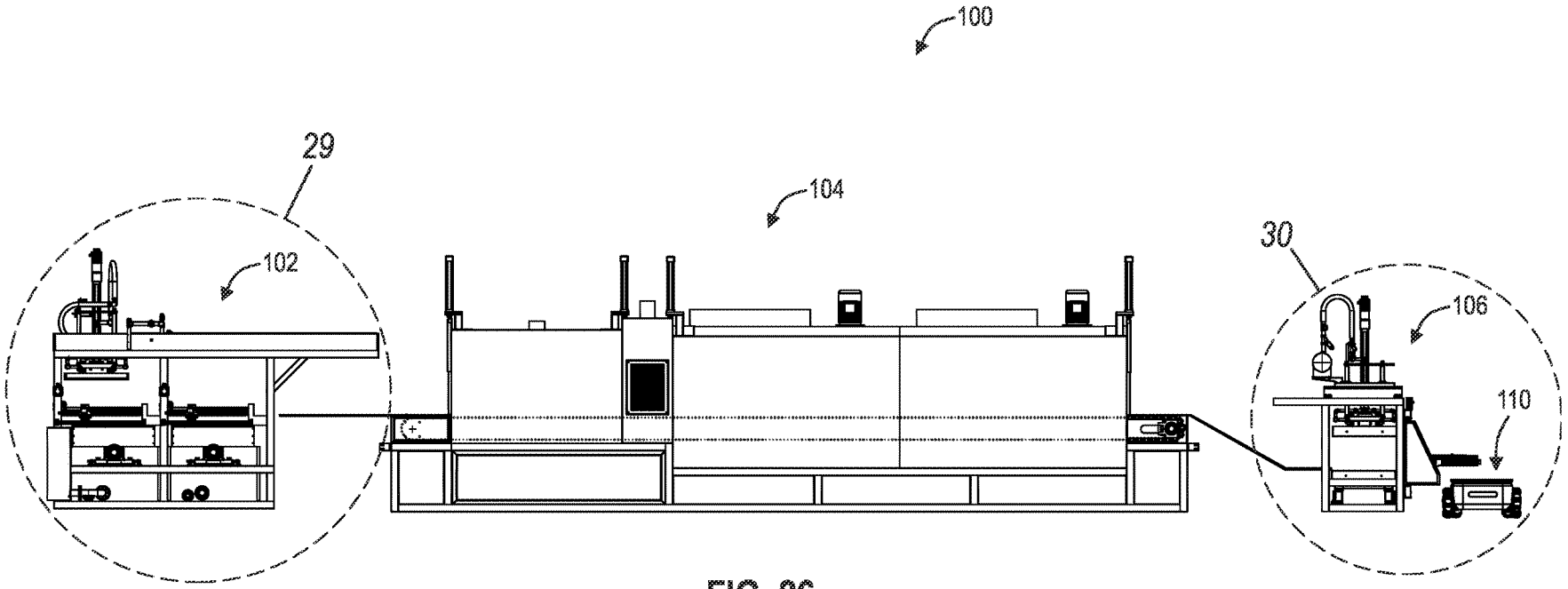
FIG. 26 is a diagrammatic side view of the example system shown in FIG. 25.
Figure 27:
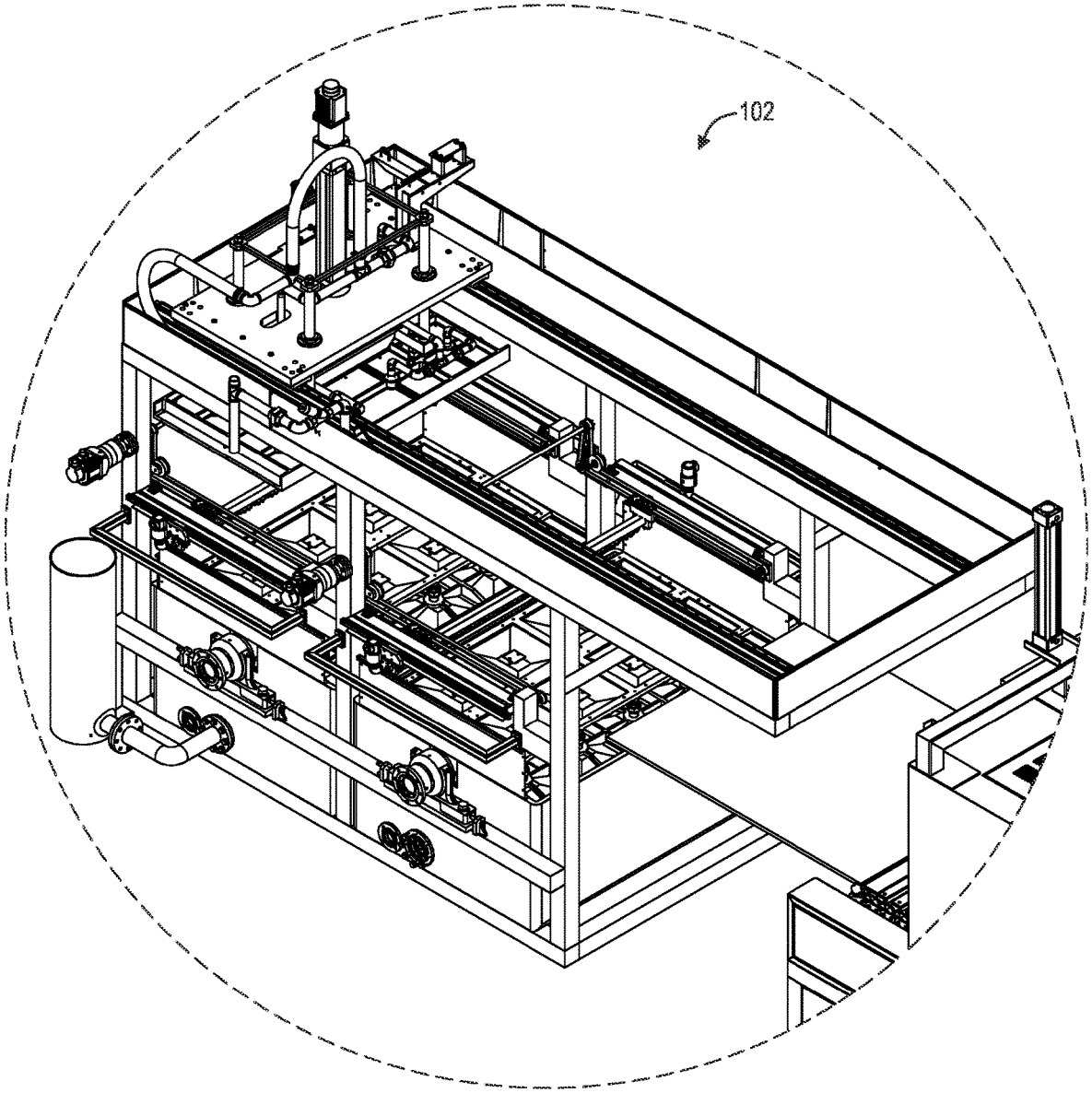
FIG. 27 is a magnified view of detail 27 in FIG. 25.
Figure 28:
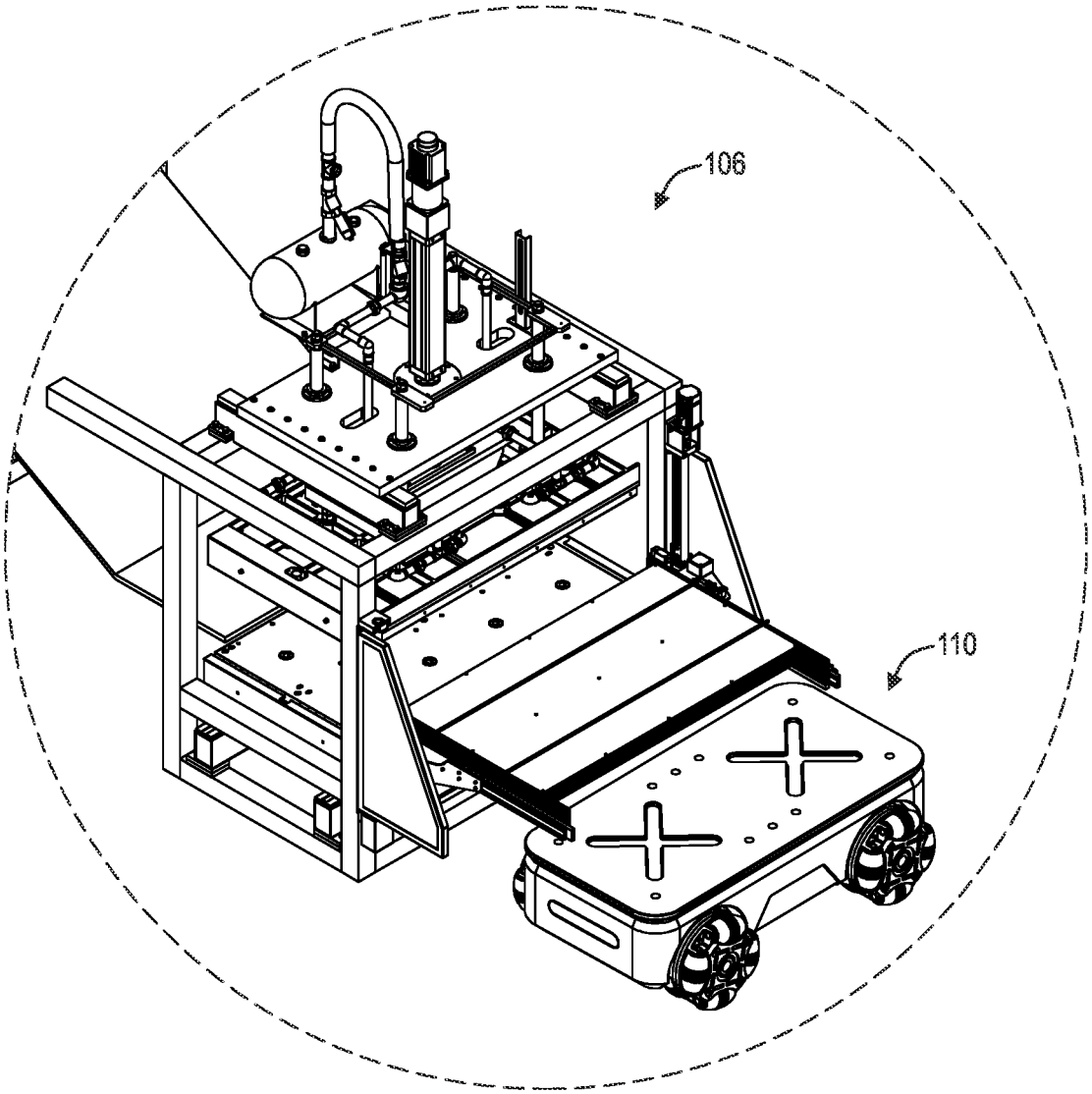
FIG. 28 is a magnified view of detail 28 in FIG. 25.

Certain example embodiments of a system for manufacturing a multi-layer composite pulp tray are shown generally at 100. Referring to FIGS. 4 and 26, the system 100 may preferably comprise a composite pulp forming machine 102, a drying line 104, and a drying and shaping machine 106. Certain preferred implementations of the system 100 may further comprise a tray rack 108 and a robotic transport vehicle 110.

Figure 6:
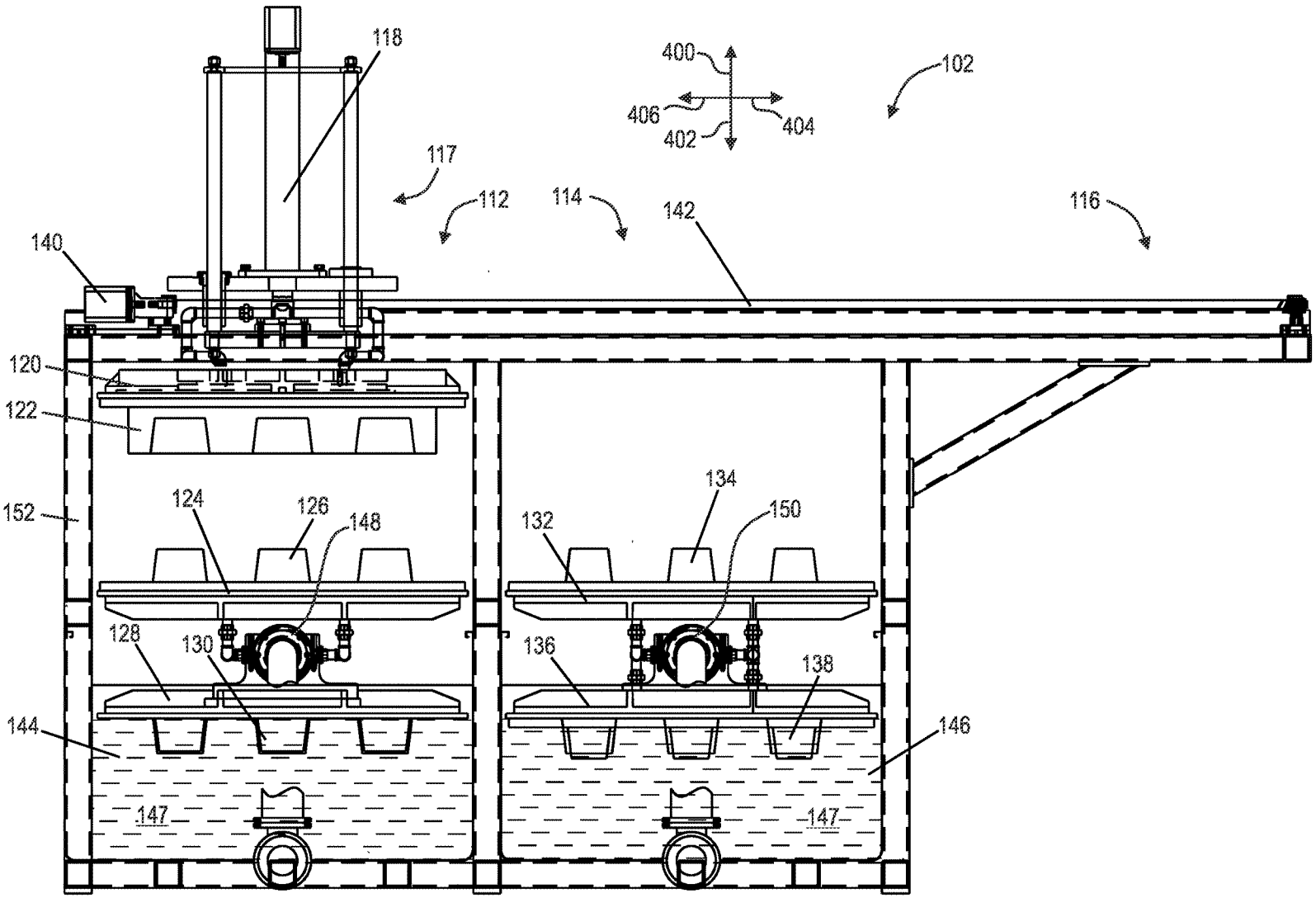
FIG. 6 is a diagrammatic side view of a non-limiting example of a composite pulp molding machine configured in accordance with an initial step in the method of manufacturing a multi-layer composite pulp tray, wherein pulp slurry has been injected into the first and second pulp slurry tanks.
Figures 10, 10A:
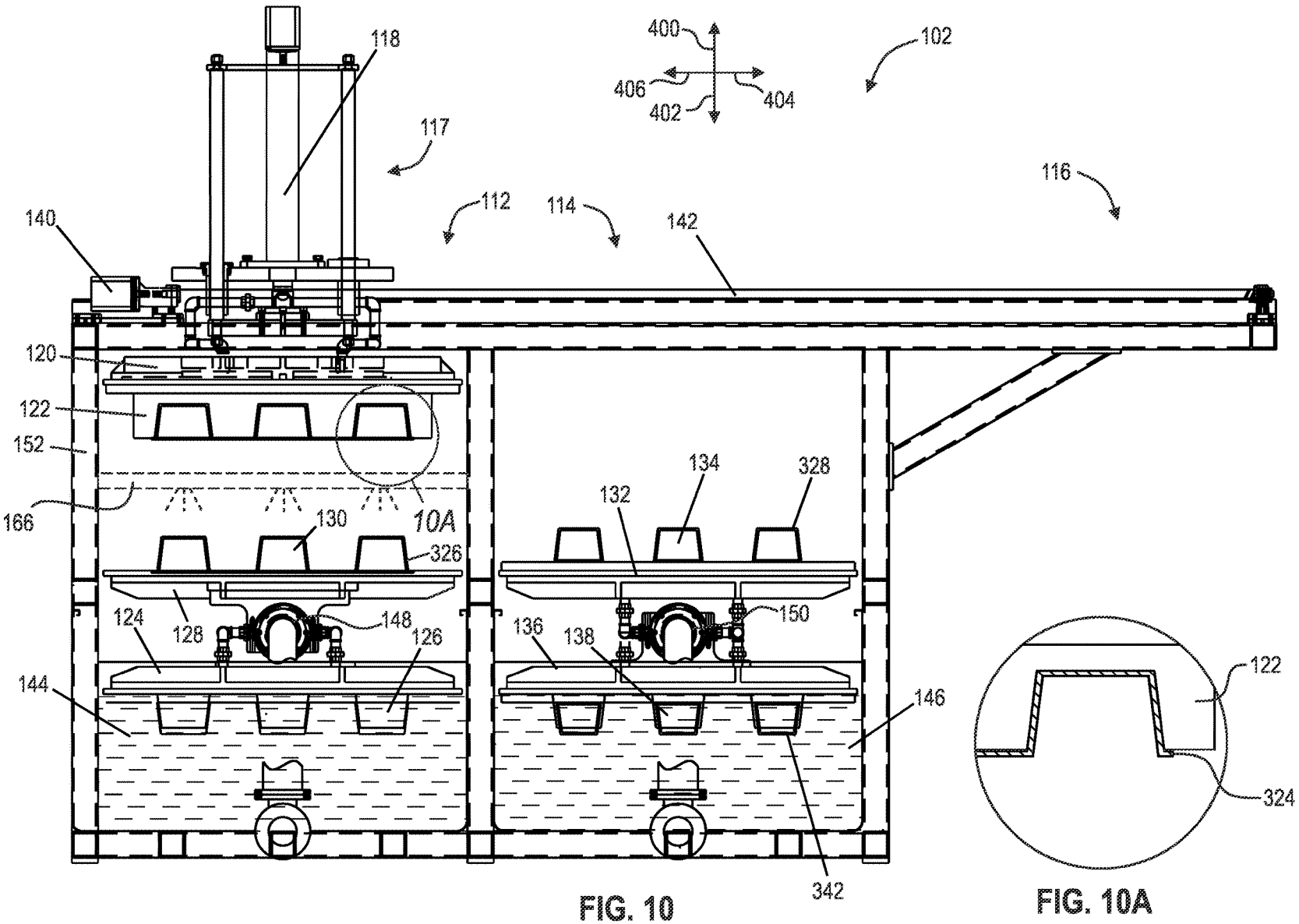
FIG. 10 is a diagrammatic side view of the example composite pulp molding machine configured in accordance with a step subsequent to that of FIG. 9, wherein the first spindle is now rotated to place the second layer forming mold in an upward position for vacuum dehydration of the pulp slurry deposited thereon.
FIG. 10A is a magnified view of detail 10A in FIG. 10.

Referring to FIG. 6, a composite pulp forming machine 102 may include a first forming station 112, a second forming station 114, a release station 116 and a transfer mold subassembly 117. The first forming station may include a first pulp slurry tank 144, a first spindle 148, a first layer forming mold 126 on a first layer forming template 124, and a second layer forming mold 130 on a second layer forming template 128. The second forming station 114 may include a second pulp slurry tank 146, a second spindle 150, a third layer forming mold 134 on a third layer forming template 132, and a fourth layer forming mold 138 on a fourth layer forming template 136. The first layer forming mold 126 and the second layer forming mold 130 may be affixed to opposing sides of the first spindle 148. Similarly, the third layer forming mold 134 and the fourth layer forming mold 138 may be affixed to opposing sides of the second spindle 150. The transfer mold subassembly 117 may include a transfer mold 122 on a transfer template 120, a transfer cylinder 118, a lateral transfer motor 140 and a lateral transfer jack screw 142. The transfer mold 122 may be configured to be raised and lowered by the transfer cylinder 118, for example moving in upward direction 400 and downward direction 402. The first pulp slurry tank 144 and the second pulp slurry tank 146 may be configured to receive and retain pulp slurry. Referring to FIG. 10, the composite pulp forming machine 102 may include a spray bar 166 for spraying a waterproof layer onto the wet formed second layer. The spray may comprise a water-based waterproof paint or the like.

Figure 14A:
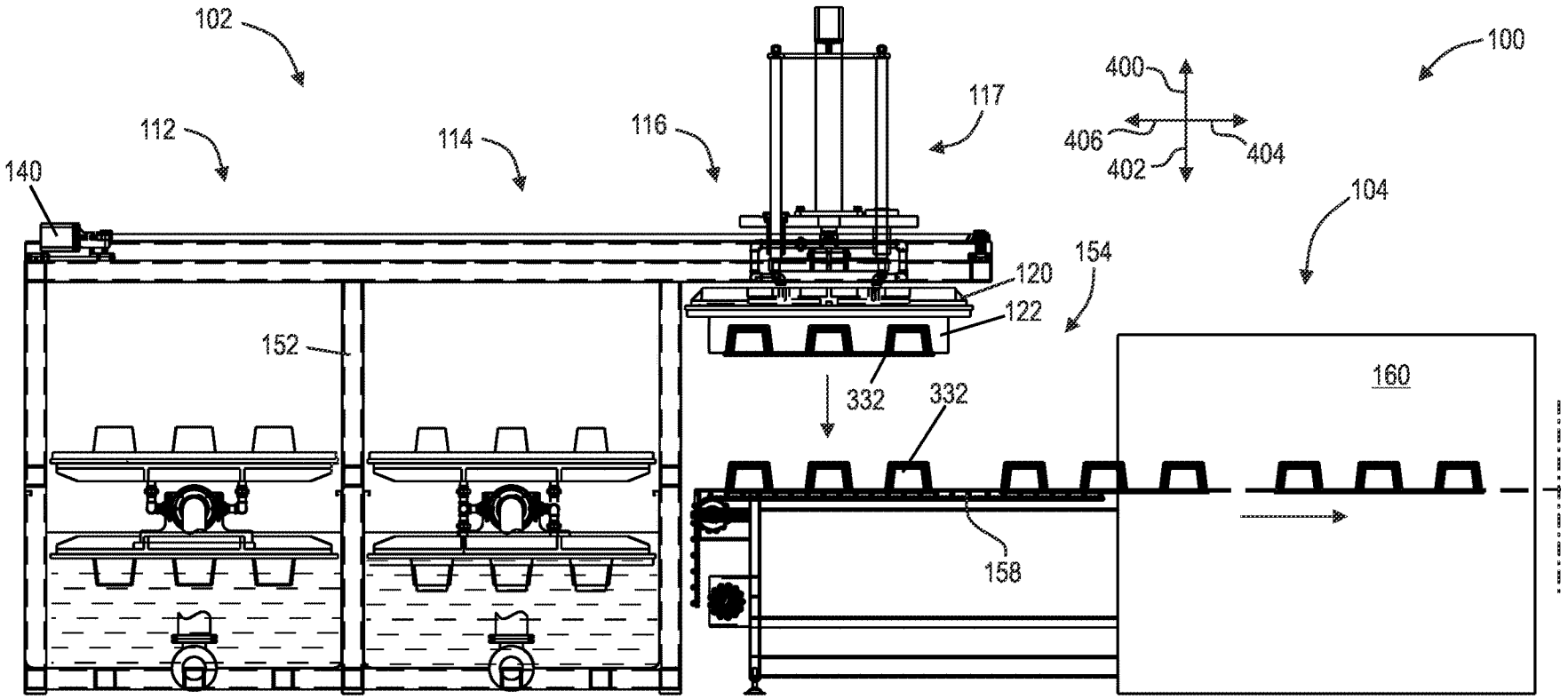
FIG. 14A is a diagrammatic side view of a first half of an overall system for manufacturing a multi-layer composite pulp tray in accordance with the present disclosure.
Figure 14B:
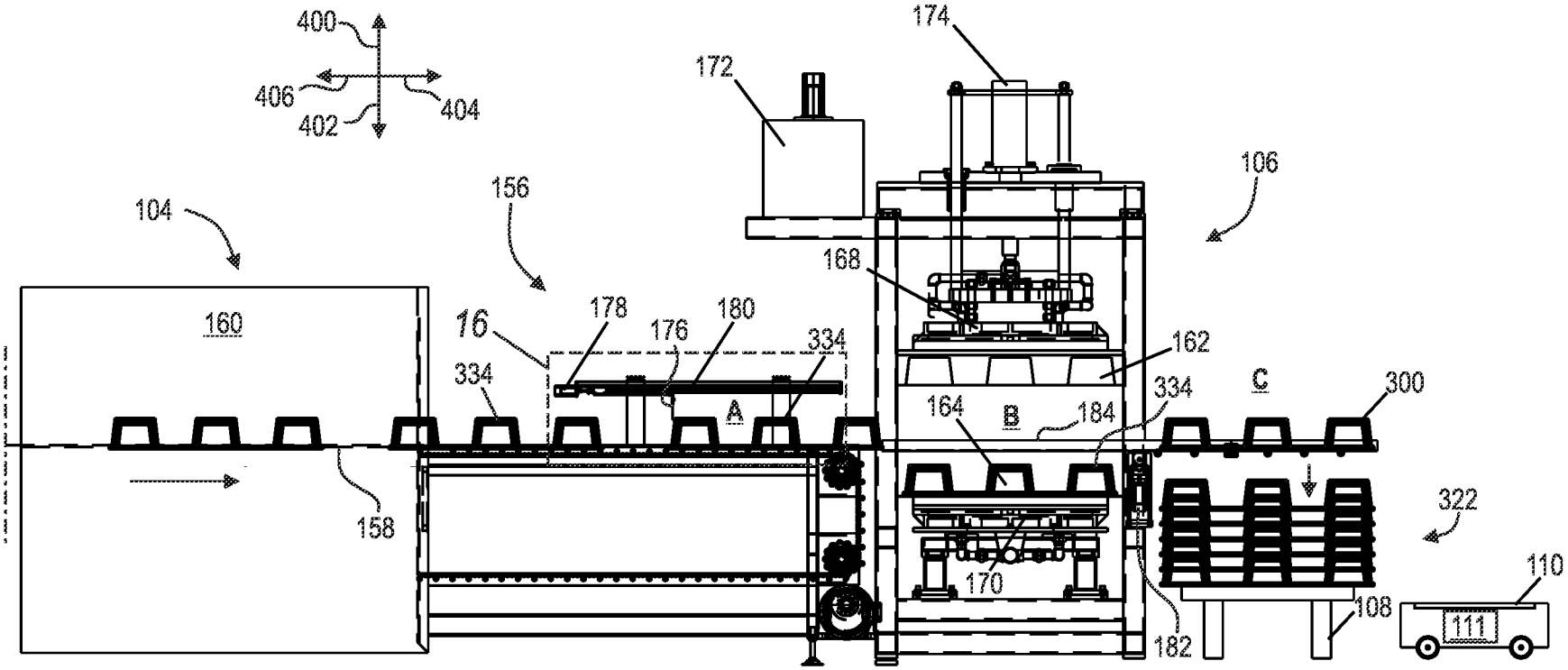
FIG. 14B is a diagrammatic side view of a second half of an overall system for manufacturing a multi-layer composite pulp tray in accordance with the present disclosure, which is a continuation of the first half illustrated in FIG. 14A.
Figure 15:
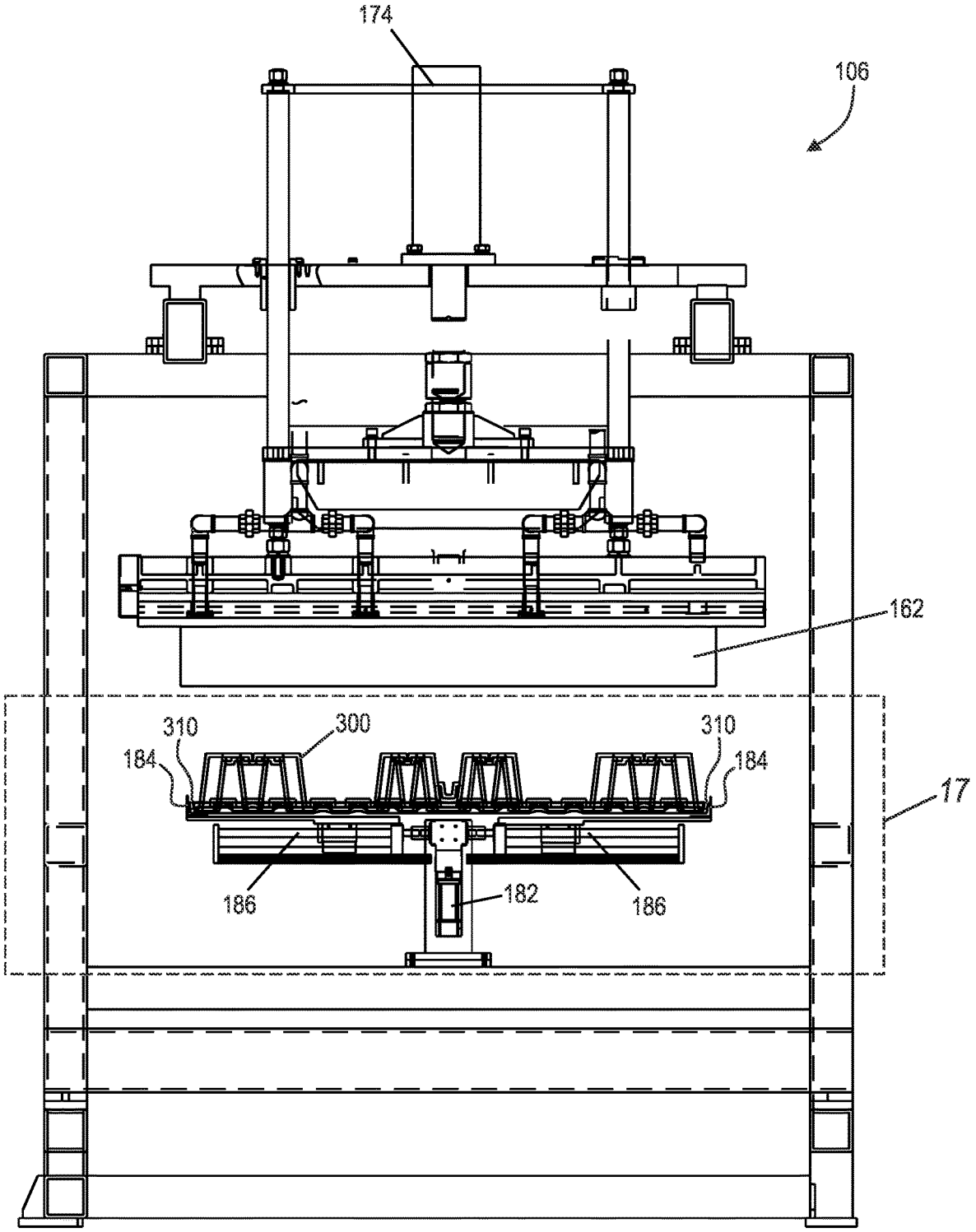
FIG. 15 is a diagrammatic end view of aspects of the drying and shaping machine shown in part of FIG. 14B.

Referring to FIGS. 4, 14A and 14B, a drying line 104 may have an inlet end 154 and an outlet end 156, a drying conveyor 158 conveyingly disposed between the inlet end 154 and the outlet end 156, and a drying box 160 through which the drying conveyor 158 extends.

Referring to FIGS. 4, 14A and 14B, the drying and shaping machine 106 may be disposed at the outlet end 156 of the drying line 104. The drying and shaping machine 106 may have an upper shaping mold 162 and a lower shaping mold 164.

Figure 17A:
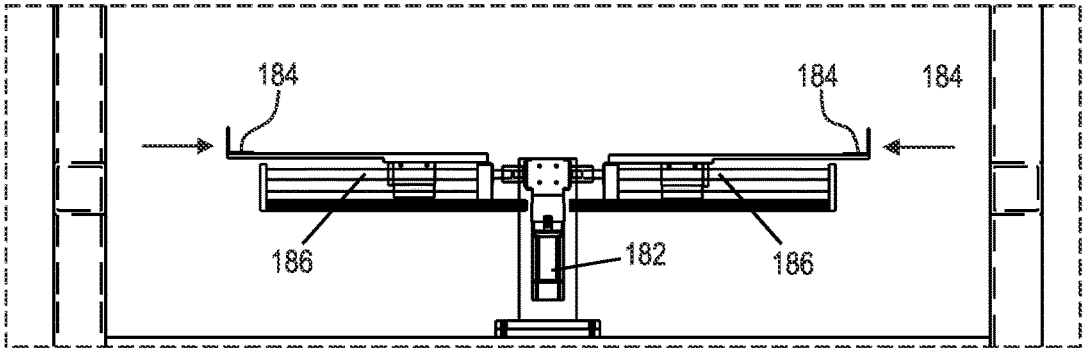
FIG. 17A is a diagrammatic view of detail 17 in FIG. 15, wherein the angle iron frames are shown in a tray guiding position.
Figure 17B:
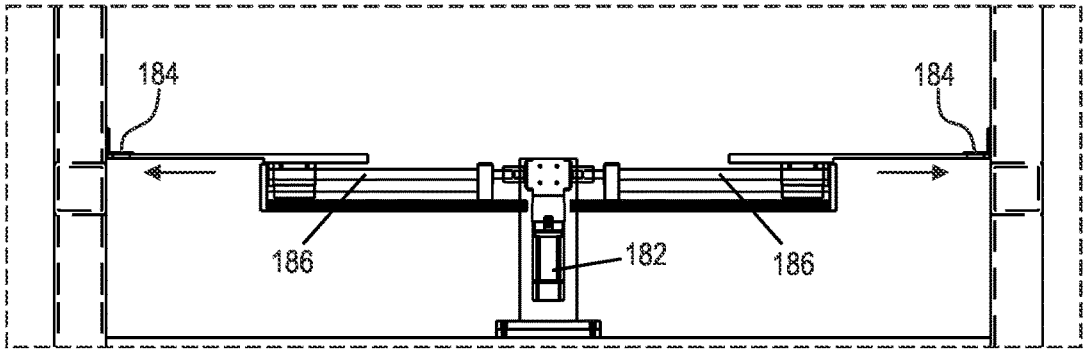
FIG. 17B is a diagrammatic view of detail 17 in FIG. 15 similar to FIG. 17A, but wherein angle iron frames are shown having been moved a tray release position.
Figure 18:
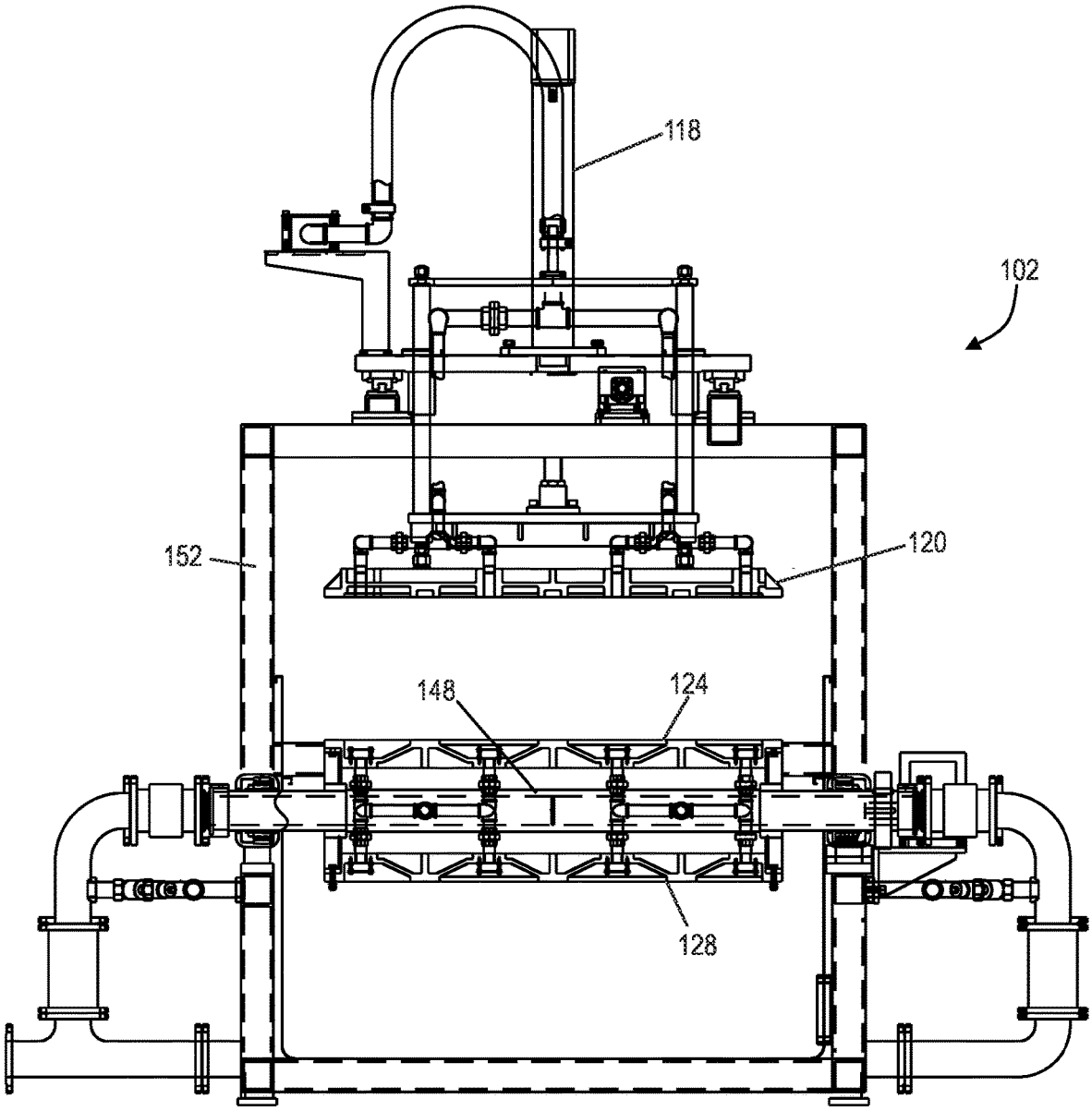
FIG. 18 is a diagrammatic end view of aspects of the composite pulp forming machine in FIG. 6.
Figure 19:
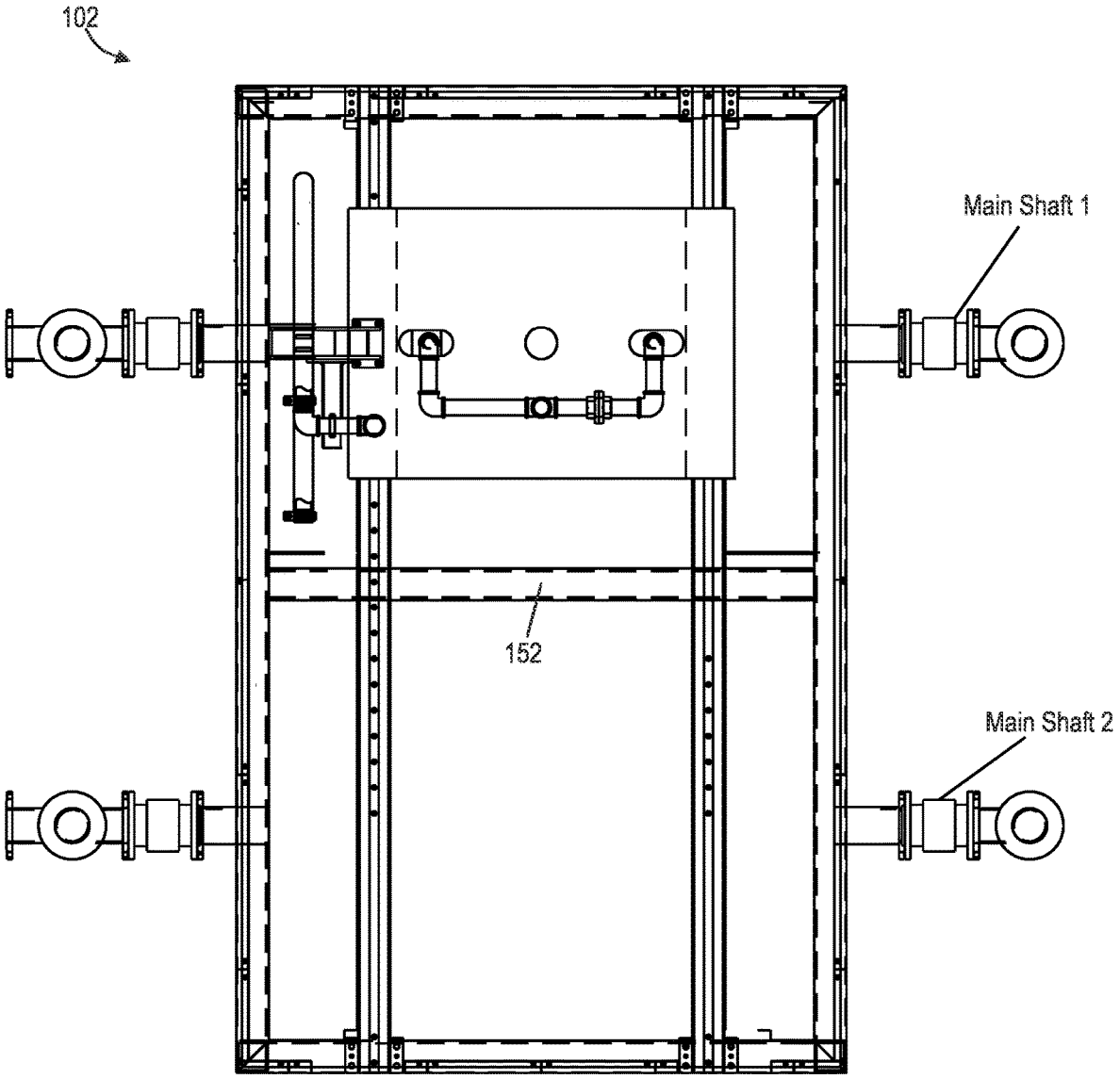
FIG. 19 is a diagrammatic bottom view of aspects of the composite pulp forming machine in FIG. 6.
Figure 20:
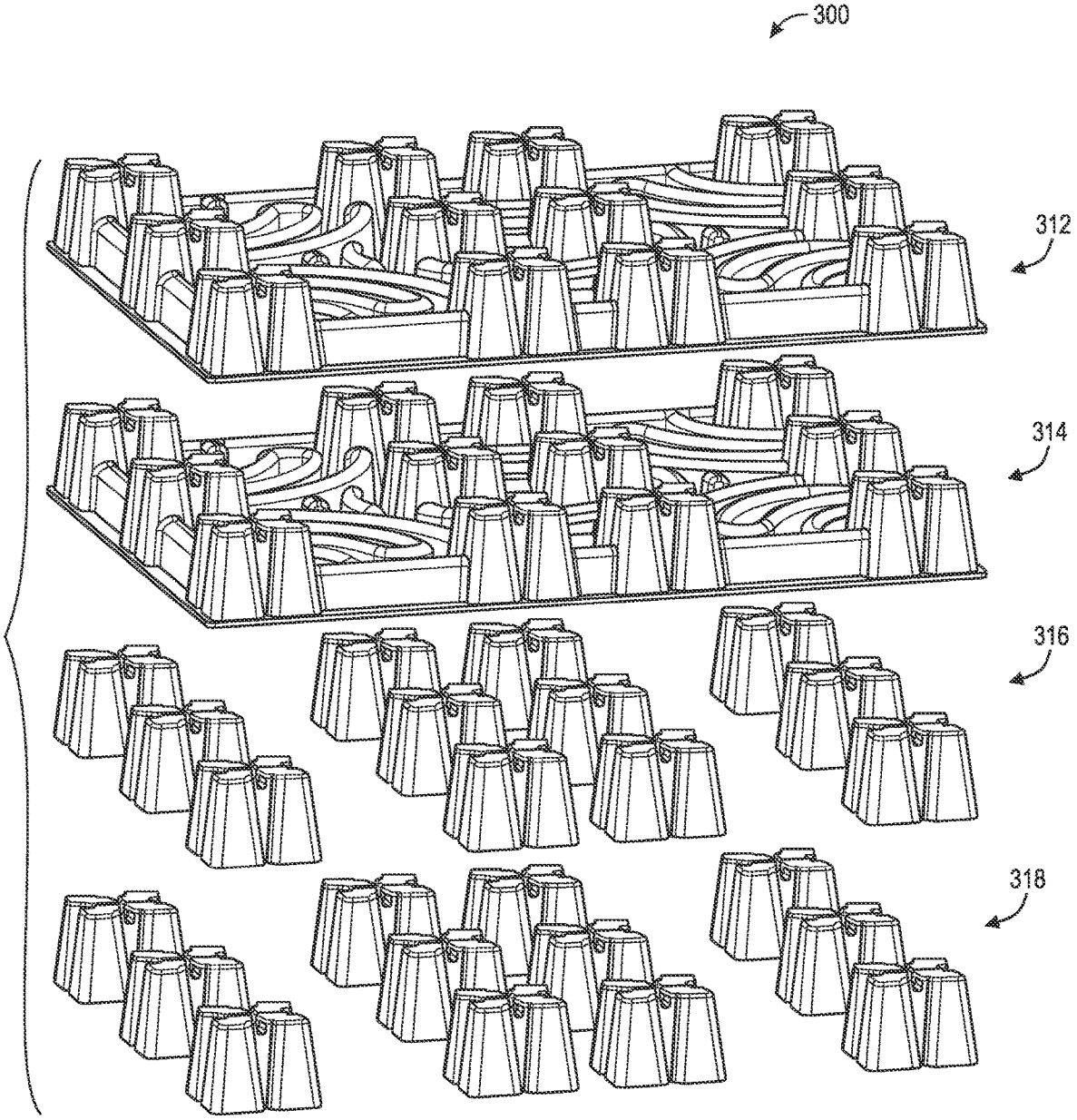
FIG. 20 is a diagrammatic exploded view of another non-limiting example of a multi-layer composite pulp tray manufactured in accordance with one non-limiting example of the system and method of the present disclosure.
Figure 21:
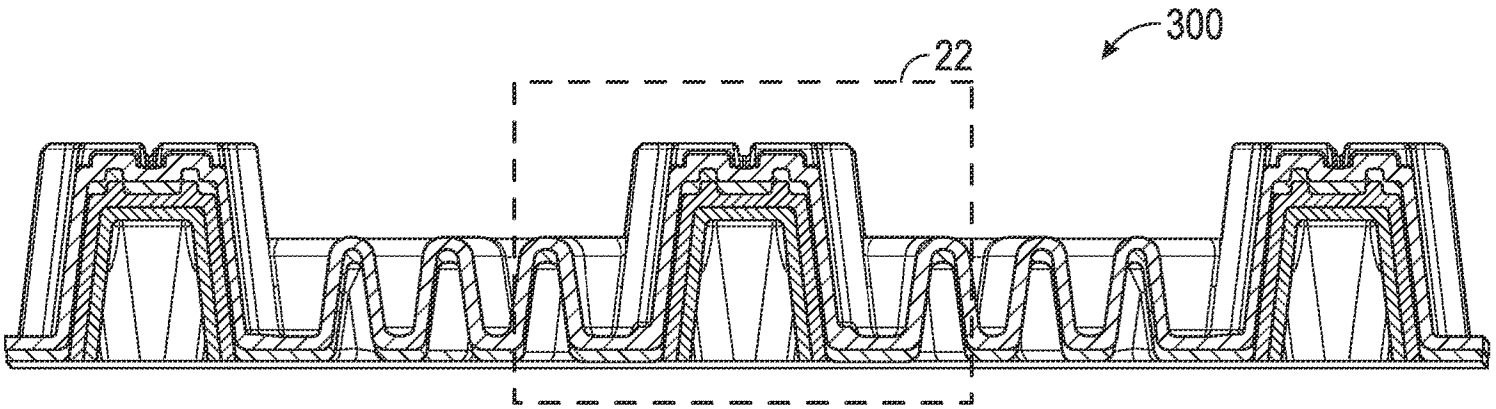
FIG. 21 is a diagrammatic cross-sectional view of the example multi-layer composite pulp tray of FIG. 20, but shown in final form.
Figure 22:
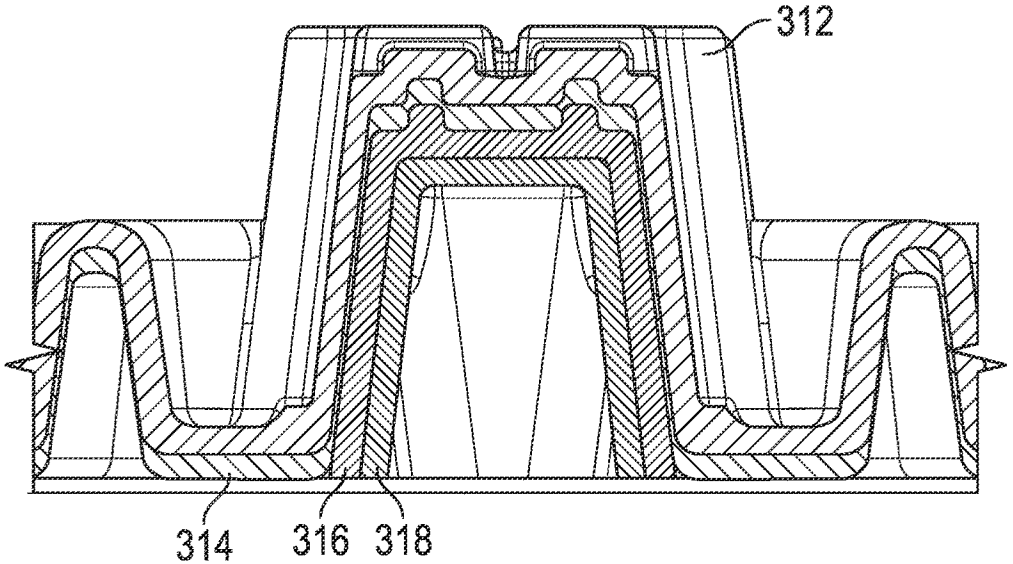
FIG. 22 is a magnified view of detail 22 in FIG. 21.
Figure 23:
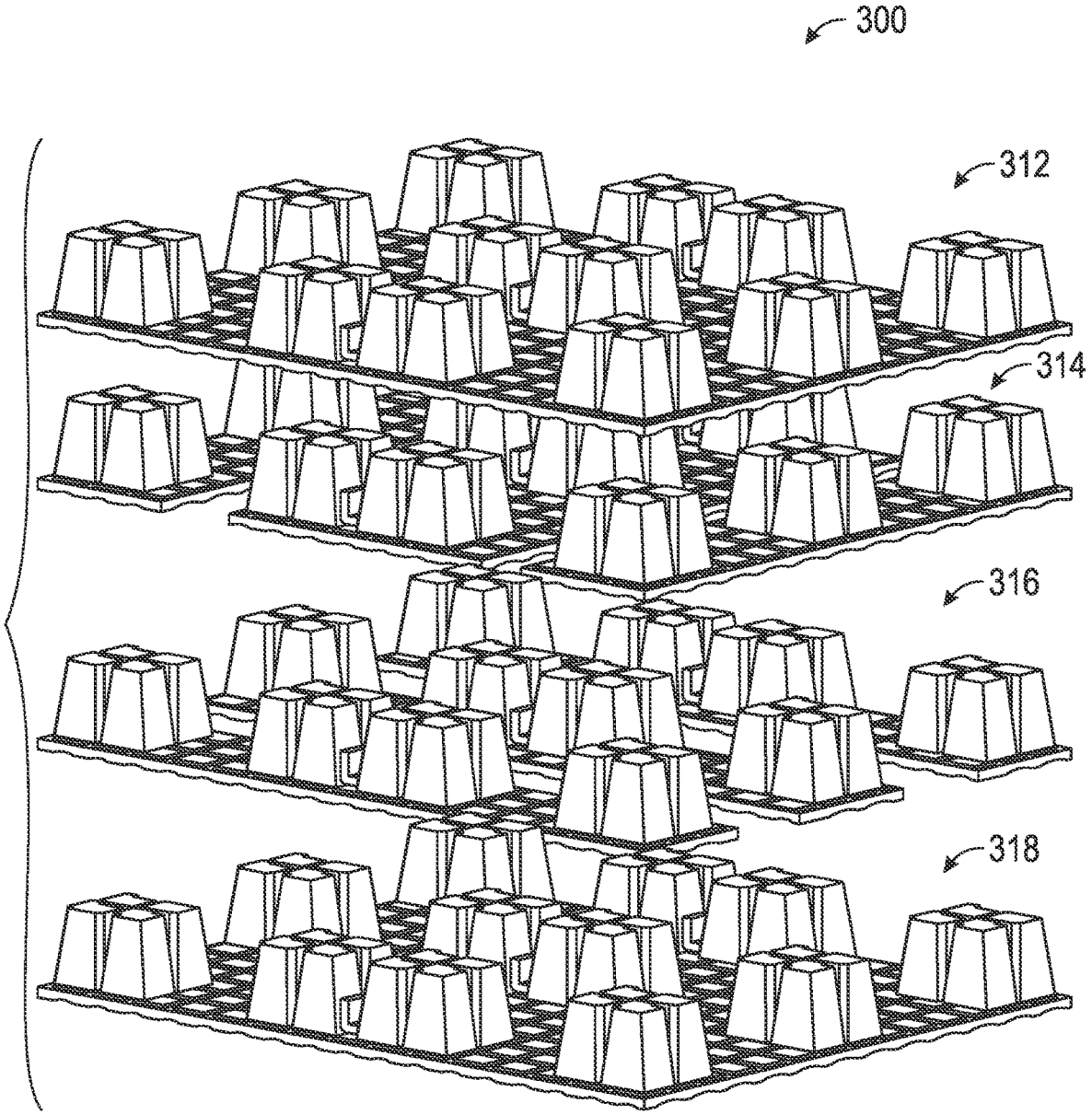
FIG. 23 is a diagrammatic exploded view of a further non-limiting example of a multi-layer composite pulp tray manufactured in accordance with one non-limiting example of the system and method of the present disclosure.
Figure 24:
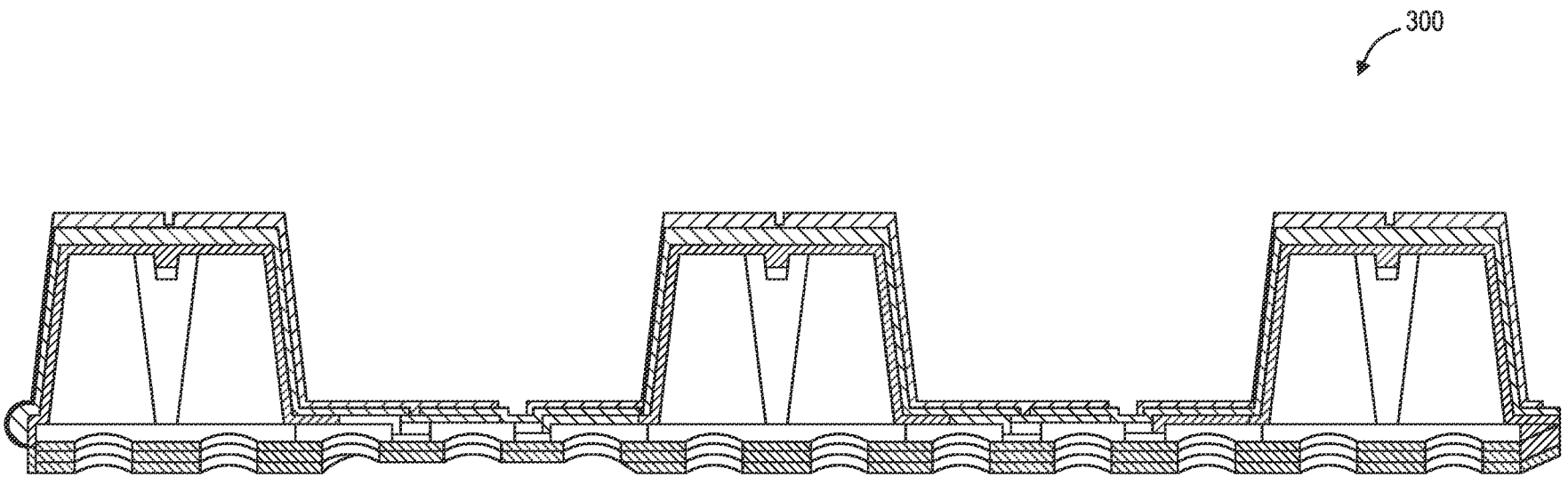
FIG. 24 is a diagrammatic cross-sectional view of the example multi-layer composite pulp tray of FIG. 23, but shown in final form.
Figure 25:
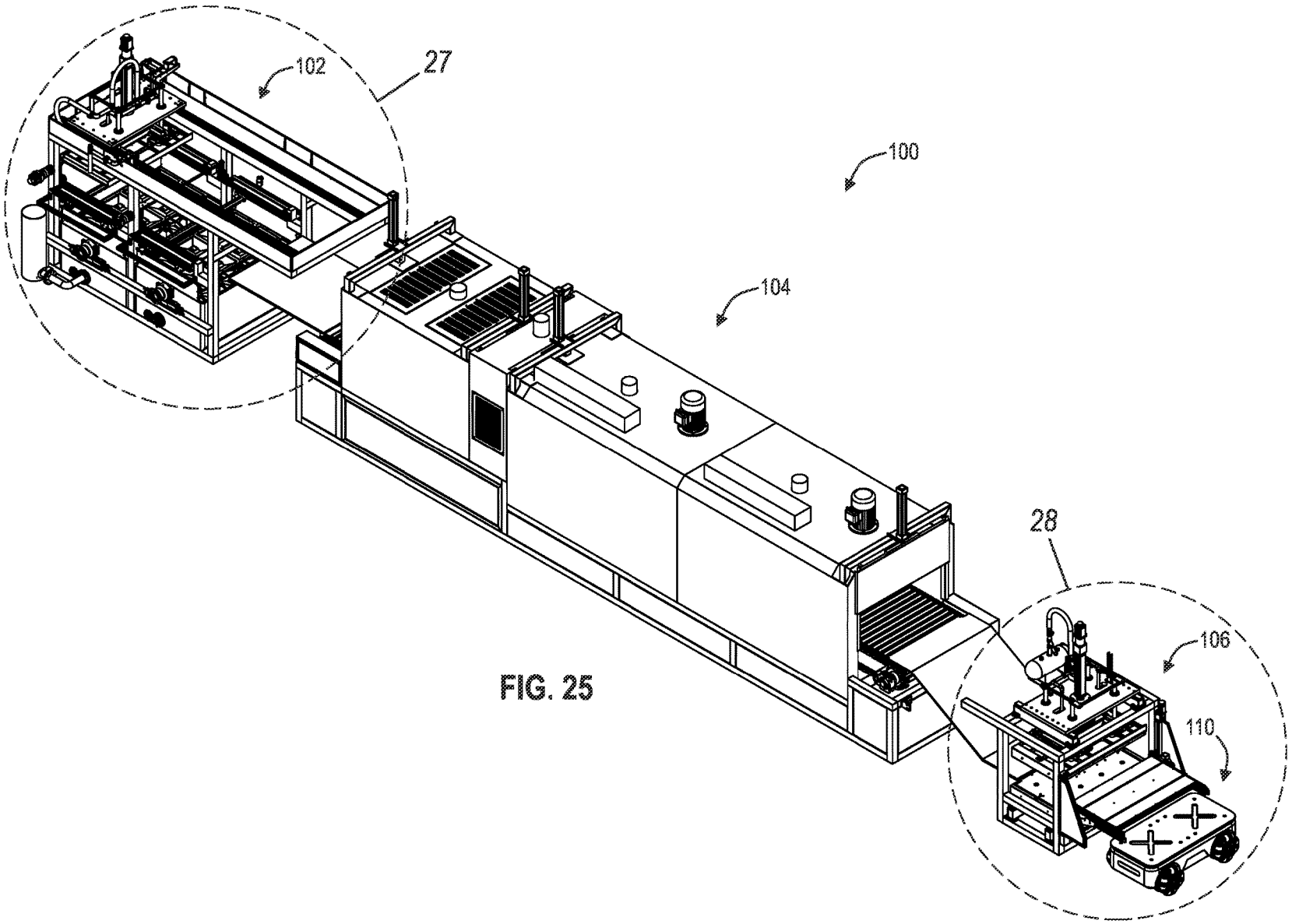
FIG. 25 is a diagrammatic perspective view of an example of a system for manufacturing a multi-layer composite pulp tray in accordance with the present disclosure.

Referring to FIGS. 14B, 15, 17A and 17B, the drying and shaping machine 106 may further include a pair of opposingly-disposed angle iron frames 184 being movable by way of a reel motor 182 toward one another into a tray guiding position (e.g., as shown in FIG. 17A), and away from one another into a tray release position (e.g., as shown in FIG. 17B).

Figure 16A:
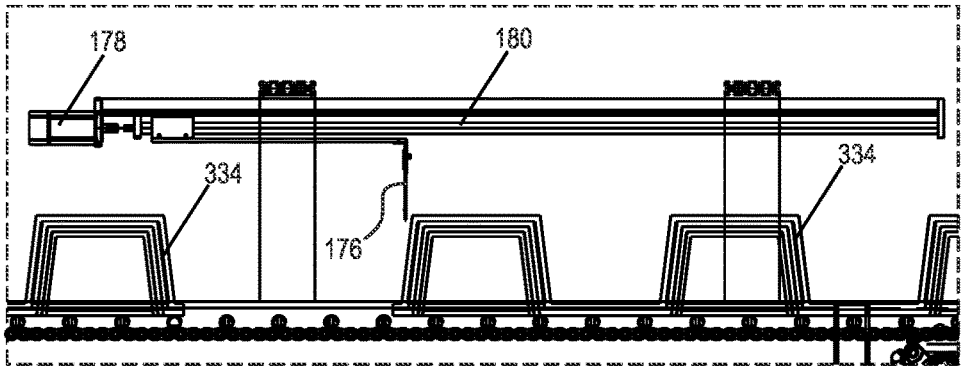
FIG. 16A is a diagrammatic view of detail 16 in FIG. 14B, wherein the push plate (scraper) is shown in start position.
Figure 16B:
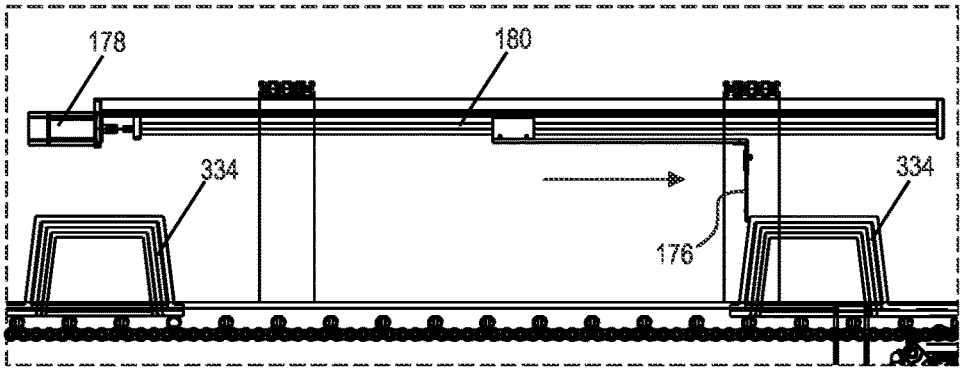
FIG. 16B is a diagrammatic view of detail 16 in FIG. 14B similar to FIG. 16A, but wherein the push plate (scraper) is shown having been moved to the end position to thereby move a semi-dry formed multi-layer composite pulp tray toward a pre-press position above the lower shaping mold.

Referring to FIGS. 14B, 16A and 16B, the drying and shaping machine 106 may include a scraper (i.e., push plate) 176 being moveable from a start position (e.g., as shown in FIG. 16A) to an end position (e.g., as shown in FIG. 16B) by way of, for example, a push slide motor 178. As illustrated for example in FIG. 14B, this movement of the push plate 176 from the start to the end position may be configured to cause movement of a semi-dry formed multi-layer composite pulp tray 334 toward a pre-press position above the lower shaping mold. The push plate 176 may be hinged (or the like) to allow it to be temporarily forced into an upwardly-folded orientation by a subsequently-positioned semi-dry formed multi-layer composite pulp tray 334 as the push plate 176 returns from the end position to the start portion.

Referring to FIG. 4, particular implementations of the system 100 may comprise a system controller 190. The system controller 190 may include, for example, a processor 192, a memory 194, and a user interface 198. The memory 194 may store non-transitory computer-readable program code 196 which, when performed by the processor 192, causes one or more of the steps in the method 200 described herein to be performed.

Figure 5:
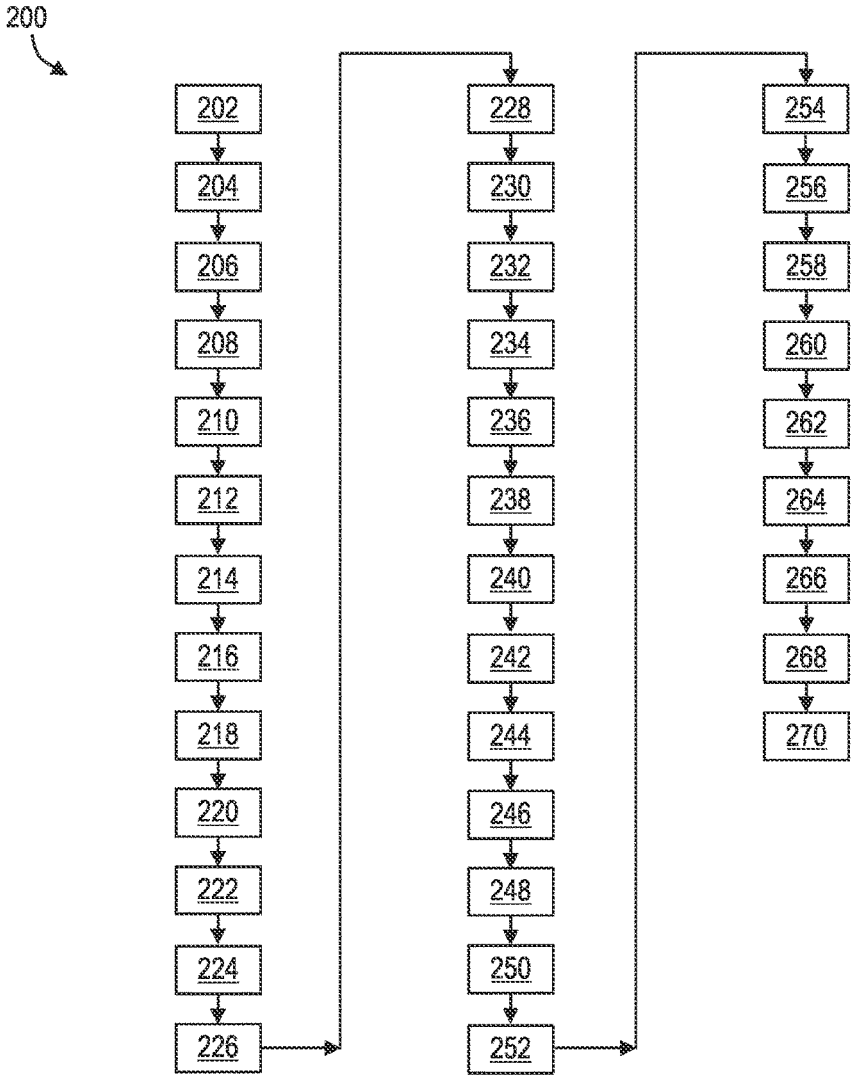
FIG. 5 is a block diagram of one or more non-limiting examples of a method of manufacturing a multi-layer composite pulp tray in accordance with the present disclosure.

One or more implementations of a method 200 of manufacturing a multi-layer composite pulp tray 300 may include some or all of the process steps represented by the blocks in FIG. 5. The steps of the method 200 may or may not be performed in the order shown in FIG. 5. Relatedly, FIGS. 4-19 illustrate aspects of preferred implementations of the system 100 as the method 200 progresses through the series of process steps.

Referring to FIGS. 5 and 6, at block 202 a composite pulp forming machine 102 may be provided. At step 210 in FIG. 5, and referring to FIG. 6, pulp slurry 147 may be injected into the first pulp slurry tank 144 and the second pulp slurry tank 146. The pulp slurry 147 may preferably have a pulp concentration of, for example, 1.2% to 1.5% pulp. In particular implementations of the system 100 and method 200, the pulp slurry in the first pulp slurry tank 144 may have a different pulp concentration than the pulp slurry in the second pulp slurry tank 146. In particular implementations of the system 100 and method 200, the first pulp slurry tank 144 and the second pulp slurry tank 146 may be defined by separate portions of a single unitary pulp slurry tank.

Figure 7:
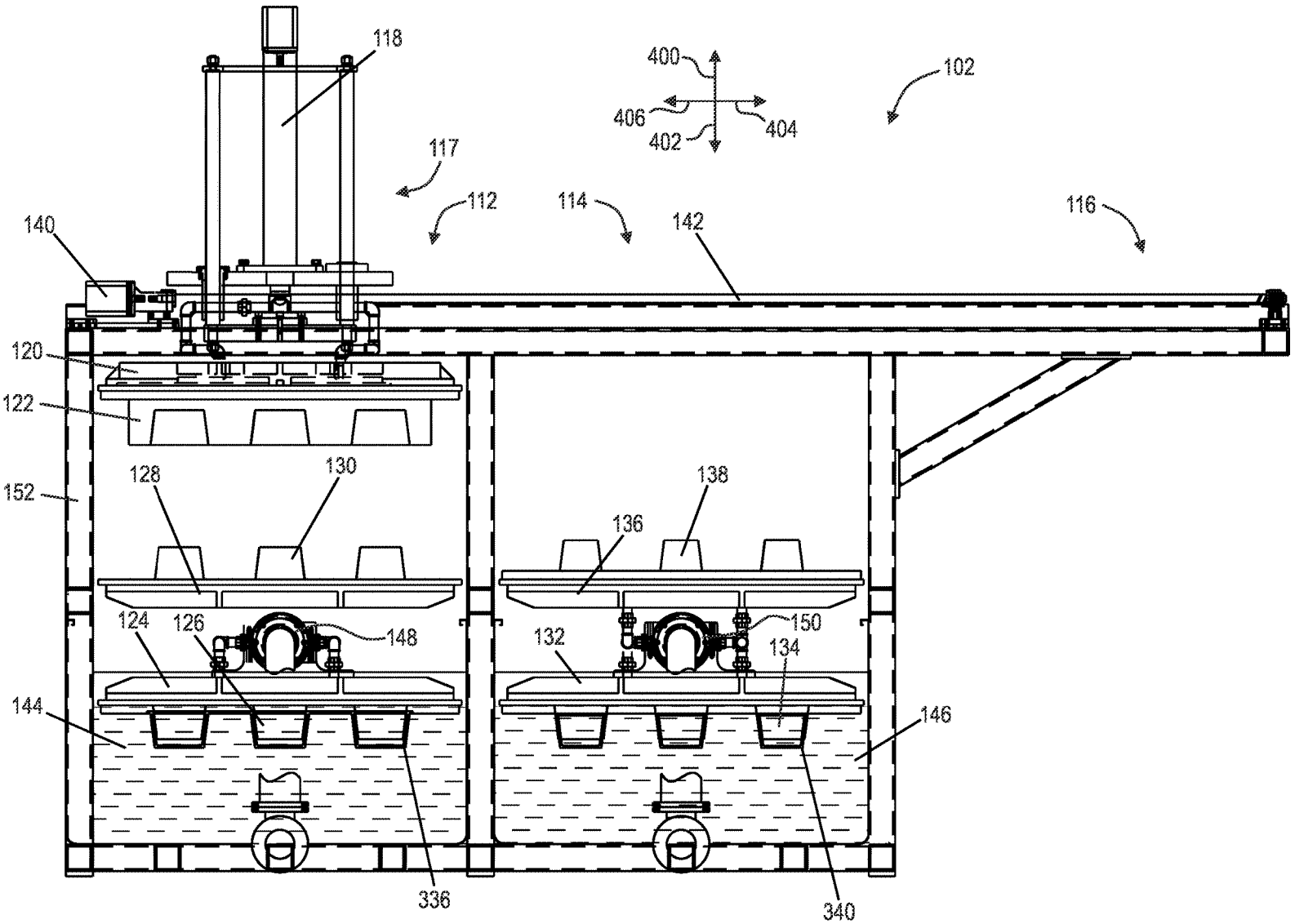
FIG. 7 is a diagrammatic side view of the example composite pulp molding machine configured in accordance with a step subsequent to that of FIG. 6, wherein the first and second spindles have now been rotated to place the first and second layer forming molds downward into their respective pulp slurry tanks.

Referring to step 212 in FIG. 5 and the composite pulp forming machine 102 in FIG. 7, the first spindle 148 may be rotated to place the first layer forming mold 126 downward into the pulp slurry within the first pulp slurry tank 144, thereby depositing pulp slurry (e.g., a first pulp slurry deposition 336) onto the first layer forming mold 126. Similarly, referring to step 214 in FIG. 5 and the composite pulp forming machine 102 in FIG. 7, the second spindle 150 may be rotated to place the third layer forming mold 134 downward into the pulp slurry within the second pulp slurry tank 146, thereby depositing pulp slurry (e.g., a third pulp slurry deposition 340) onto the third layer forming mold 134.

Figure 8:
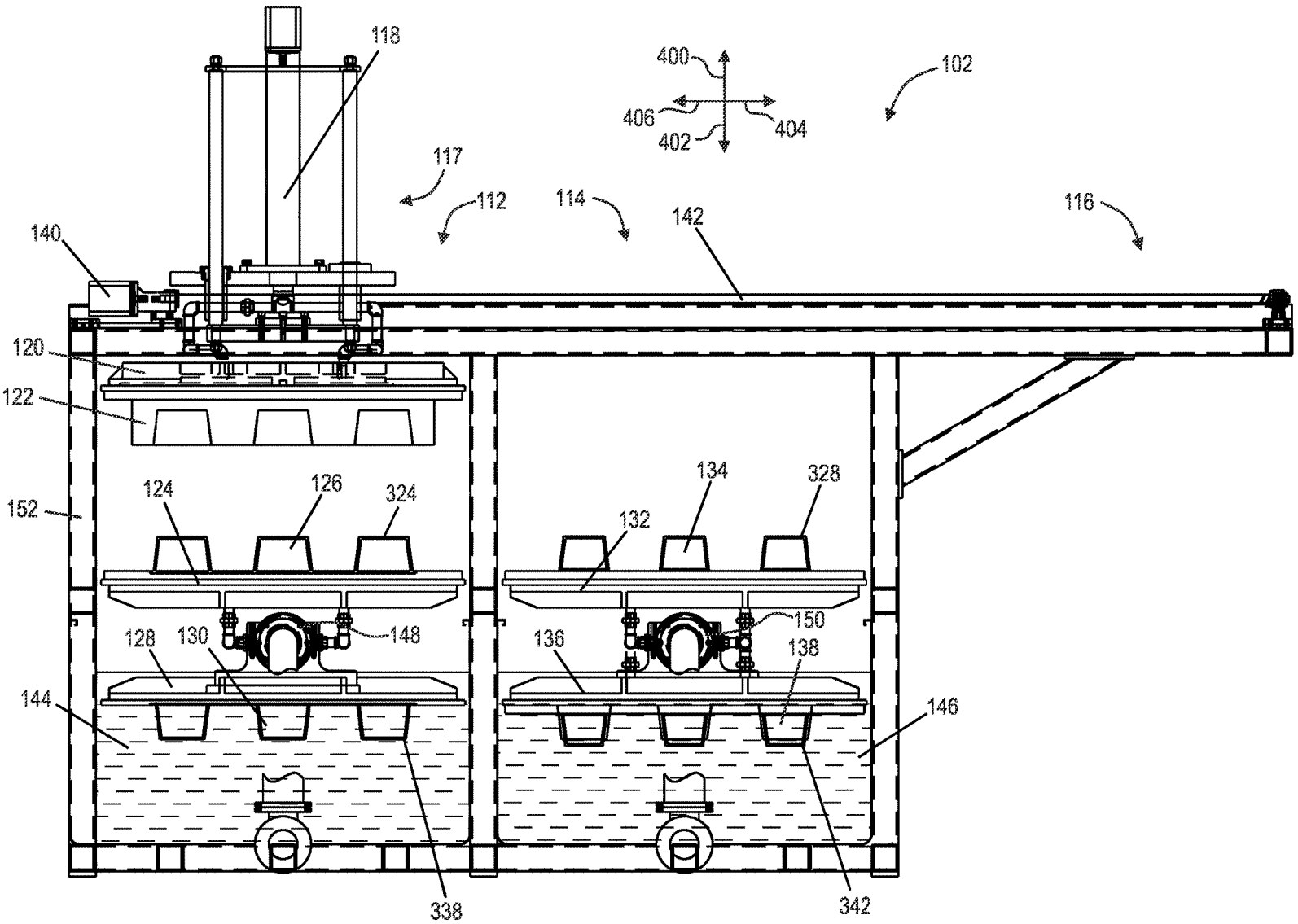
FIG. 8 is a diagrammatic side view of the example composite pulp molding machine configured in accordance with a step subsequent to that of FIG. 7, wherein the first and second spindles have now been flipped to place the first and second layer forming molds in an upward position for vacuum dehydration of the pulp slurry deposited thereon.

Referring to step 216 in FIG. 5 and the composite pulp forming machine 102 in FIG. 8, the first spindle may be flipped 180 rotational degrees to place the first layer forming mold 126 in an upward position and to place the second layer forming mold 130 downward into the pulp slurry within the first pulp slurry tank 144, thereby depositing pulp slurry (e.g., a second pulp slurry deposition 338) onto the second layer forming mold 130.

Referring to step 218 in FIG. 5 and the composite pulp forming machine 102 in FIG. 8, the pulp slurry deposited on the first layer forming mold 126 may be vacuum dehydrated, thereby forming a wet formed first layer 324.

Figures 9, 9A:
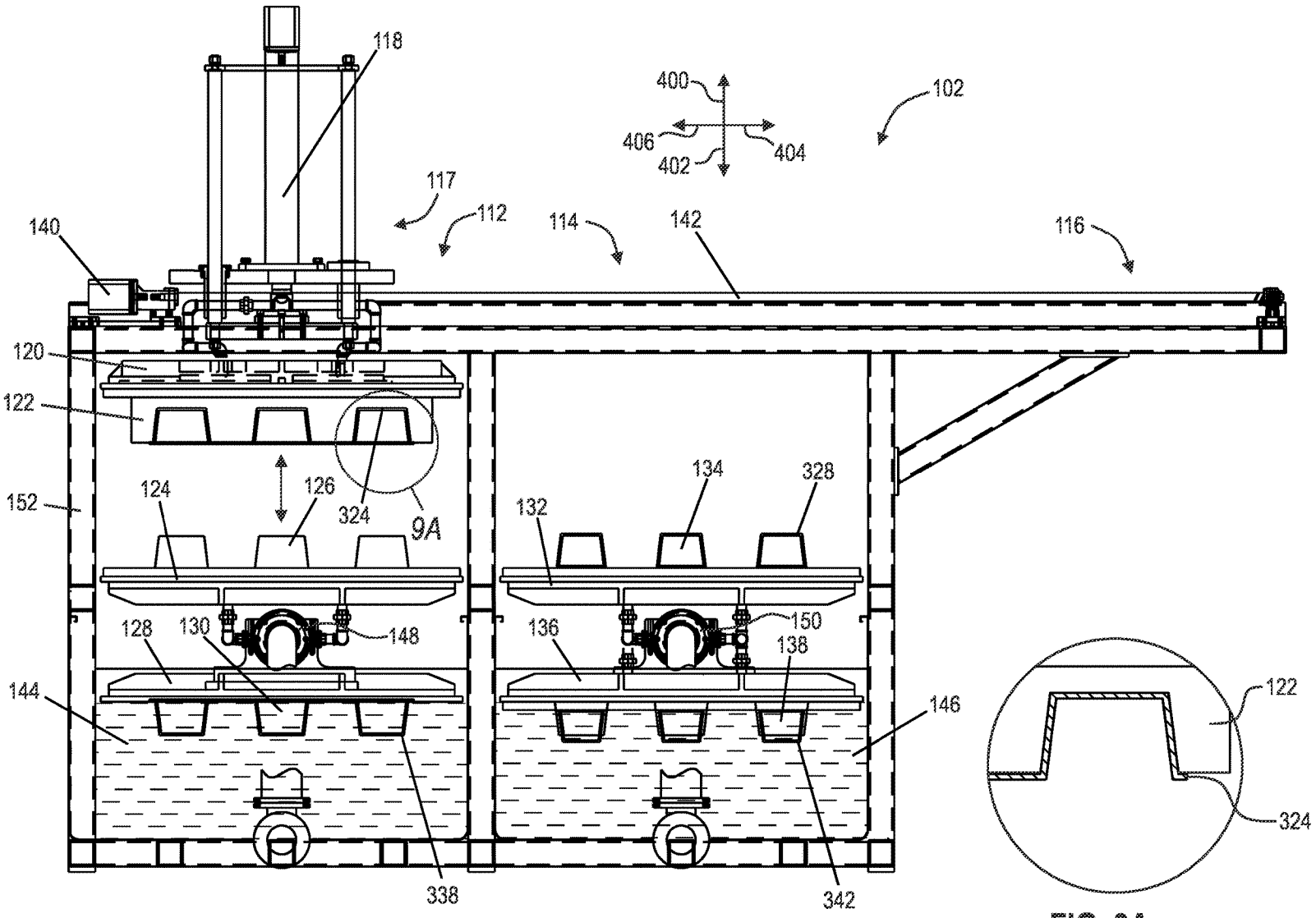
FIG. 9 is a diagrammatic side view of the example composite pulp molding machine configured in accordance with a step subsequent to that of FIG. 8, wherein the transfer mold has now been moved vertically into and out of engagement with the first layer forming mold to suctionally retain the wet formed first layer in the transfer mold.
FIG. 9A is a magnified view of detail 9A in FIG. 9.

Referring to step 220 in FIG. 5 and the composite pulp forming machine 102 in FIG. 9, the transfer mold 122 may be lowered (e.g., in downward direction 402) into engagement with the first layer forming mold 126, and suction may be applied to transfer the wet formed first layer 324 to the transfer mold 122. Referring to step 222 in FIG. 5, the transfer mold 122 may then be raised (e.g., in upward direction 400) out of engagement with the first layer forming mold 126 with the wet formed first layer 324 being retained in the transfer mold 122 (e.g., as shown in FIG. 9A).

Referring to step 224 in FIG. 5 and the composite pulp forming machine 102 in FIG. 10, the first spindle 148 may be flipped 180 rotational degrees to place the second layer forming mold 130 in an upward position and returning the first layer forming mold 126 downward into the pulp slurry within the first pulp slurry tank 144. The pulp slurry deposited on the second layer forming mold 130 may then be vacuum dehydrated, thereby forming a wet formed second layer 326.

Figures 11, 11A:
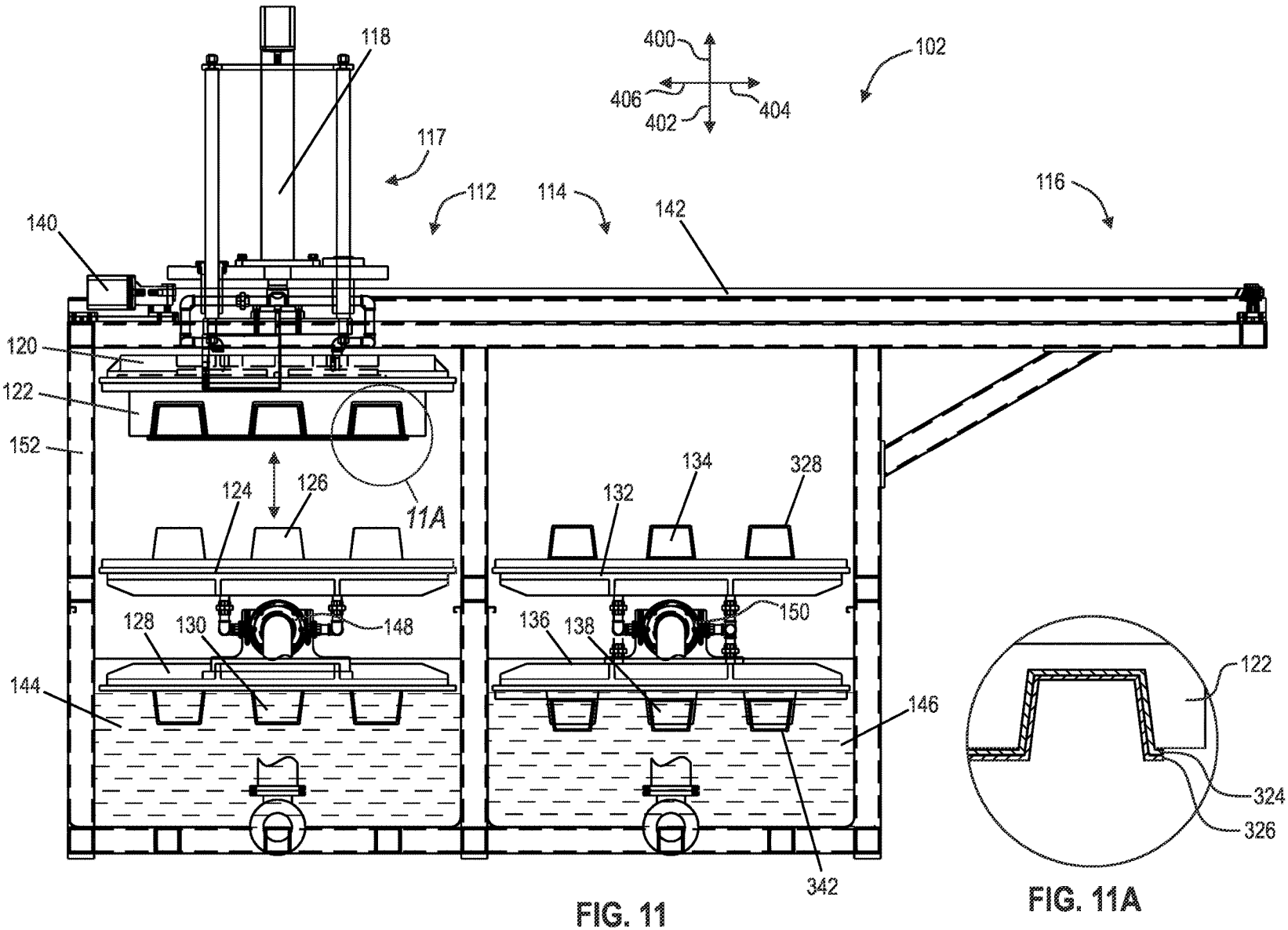
FIG. 11 is a diagrammatic side view of the example composite pulp molding machine configured in accordance with a step subsequent to that of FIG. 10, wherein the transfer mold has now been moved vertically into and out of engagement with the second layer forming mold to suctionally retain the wet formed second layer in the transfer mold along with the wet formed first layer, and the spindle has been flipped to return the second layer forming mold downward into the first pulp slurry tank.
FIG. 11A is a magnified view of detail 11A in FIG. 11.

Referring to step 226 in FIG. 5 and the composite pulp forming machine 102 in FIG. 11, the transfer mold 122 with the wet formed first layer 324 may be lowered (e.g., in downward direction 402) into engagement with the second layer forming mold 130, and suction may be applied to transfer the wet formed second layer 326 to the transfer mold 122 with the wet formed first layer 324 remaining disposed between the transfer mold 122 and the wet formed second layer 326. Referring to step 228 in FIG. 5 and the composite pulp forming machine 102 in FIG. 11, the transfer mold 122 may then be raised (e.g., in upward direction 400) out of engagement with the second layer forming mold 130, with the transfer mold 122 retaining the wet formed first layer 324 and the wet formed second layer 326 (see, e.g., FIG. 11A).

Figures 12, 12A:
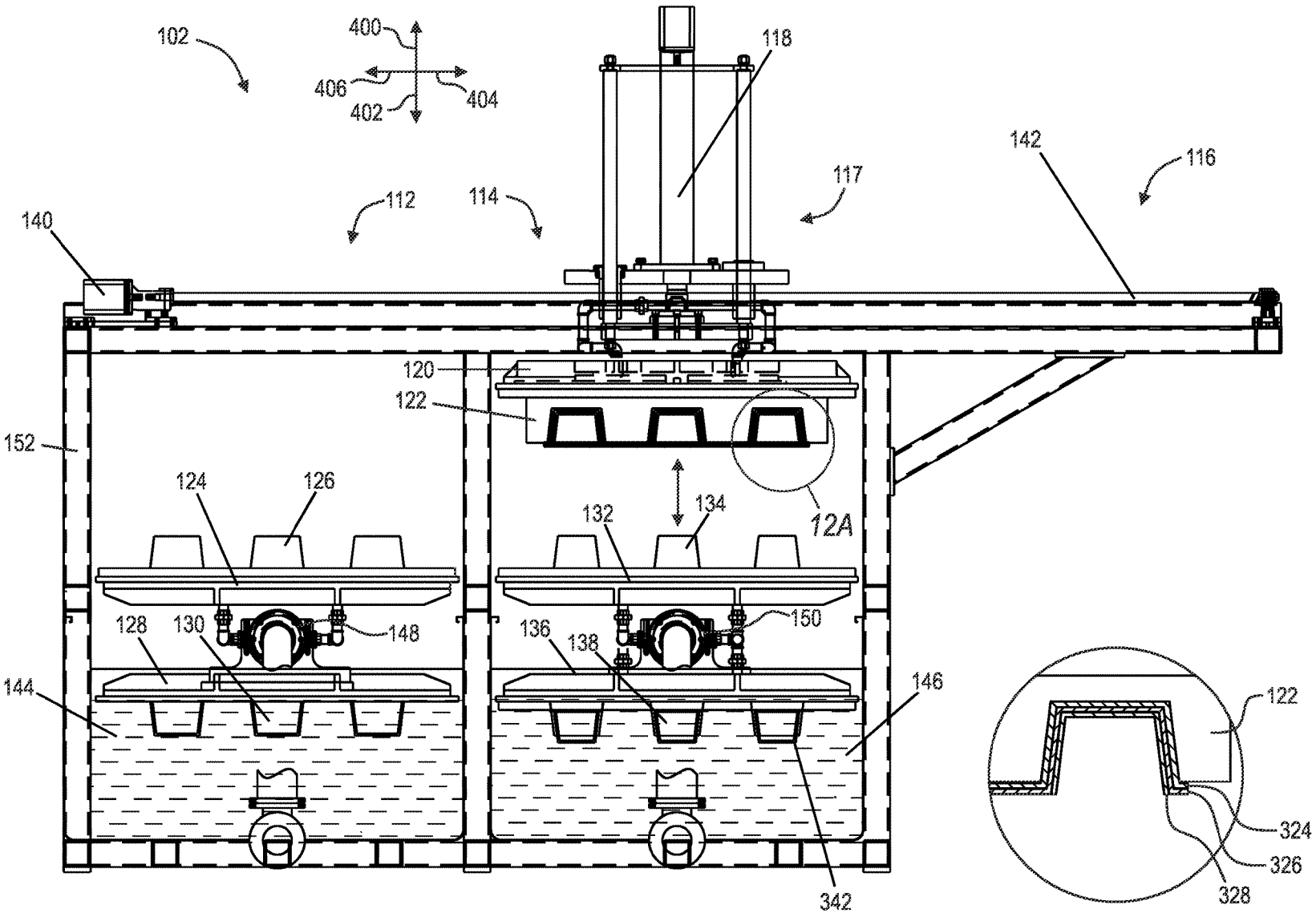
FIG. 12 is a diagrammatic side view of the example composite pulp molding machine configured in accordance with a step subsequent to that of FIG. 11, wherein the transfer mold has now been laterally transported to the second forming station, and has been moved vertically into and out of engagement with the third layer forming mold to suctionally retain the wet formed third layer in the transfer mold along with the wet formed first and second layers.
FIG. 12A is a magnified view of detail 12A in FIG. 12.

Referring to step 230 in FIG. 5 and the composite pulp forming machine 102 in FIG. 12, the transfer mold 122 may be laterally transported (e.g., in forward direction 404) from the first forming station 112 to the second forming station 114, with the transfer mold 122 retaining the wet formed first layer and 324 the wet formed second layer 326. Referring to step 232 in FIG. 5 and the composite pulp forming machine 102 in FIG. 12, the second spindle 150 may be flipped 180 rotational degrees to place the third layer forming mold 134 in an upward position and to place the fourth layer forming mold 138 into the pulp slurry within the second pulp slurry tank 146, thereby depositing pulp slurry (e.g., a fourth pulp slurry deposition 342) onto the fourth layer forming mold 138.

Referring to step 234 in FIG. 5 and the composite pulp forming machine 102 in FIG. 8, the pulp slurry deposited on the third layer forming mold 134 may be vacuum dehydrated, thereby forming a wet formed third layer 328.

Referring to step 236 in FIG. 5 and the composite pulp forming machine 102 in FIG. 12, the transfer mold 122 with the wet formed first layer 324 and wet formed second layer 326 may be lowered into engagement with the third layer forming mold 134. Suction may then be applied to transfer the wet formed third layer 328 to the transfer mold 122 with the wet formed first layer 324 and wet formed second layer 326 remaining disposed between the transfer mold 122 and the wet formed third layer 328 (see, e.g., FIG. 12A).

Figure 13:
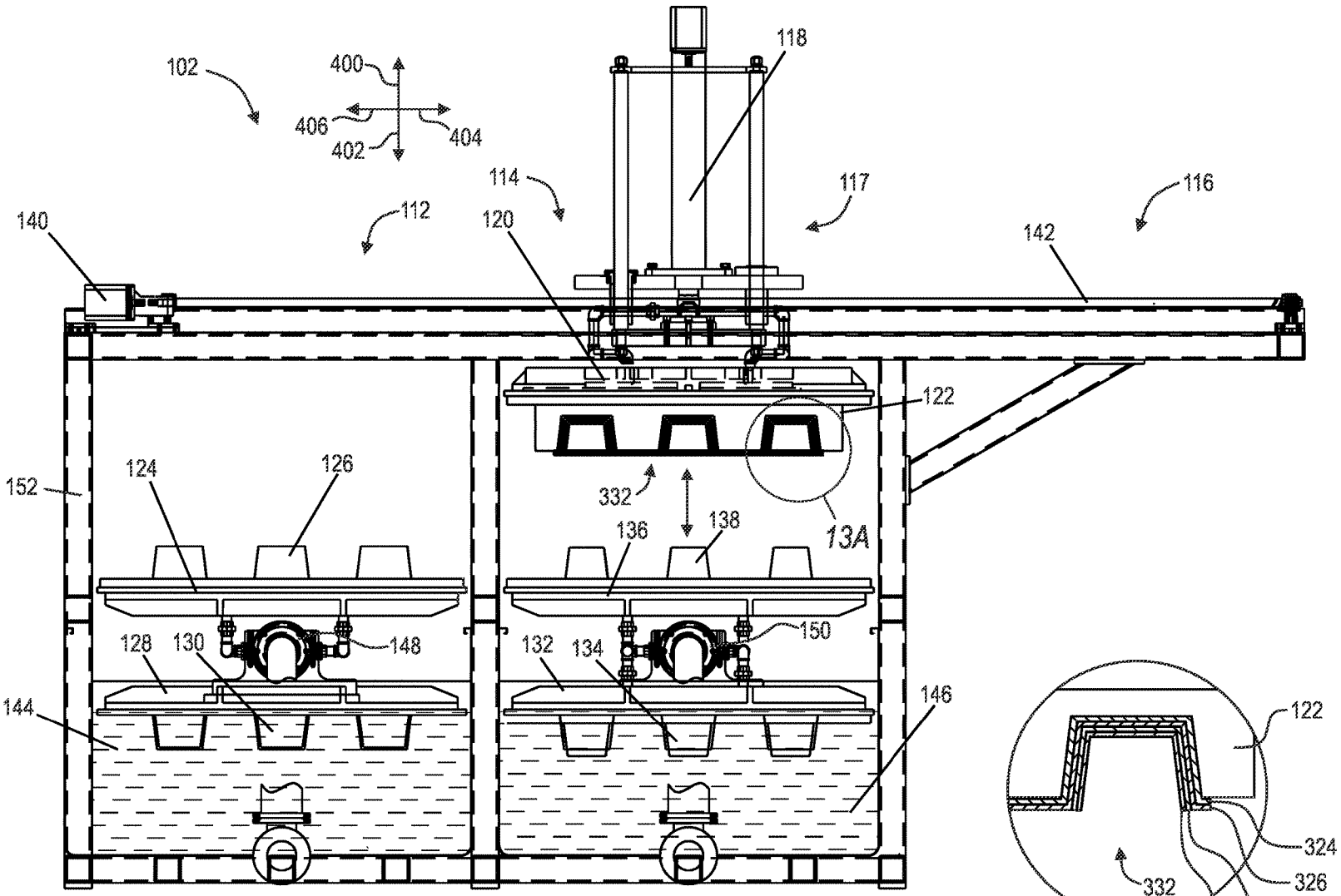
FIG. 13 is a diagrammatic side view of the example composite pulp molding machine configured in accordance with a step subsequent to that of FIG. 12, wherein the second spindle has now been flipped to place the second layer forming mold into an upward position, and the transfer mold has been moved vertically into and out of engagement with the fourth layer forming mold to suctionally retain the wet formed fourth layer in the transfer mold along with the wet formed first, second and third layers.

Referring to step 238 in FIG. 5 and the composite pulp forming machine 102 in FIG. 13, the second spindle 150 may be flipped 180 rotational degrees to place the fourth layer forming mold 138 in an upward position and returning the third layer forming mold 134 into the pulp slurry within the second pulp slurry tank 146. Referring to step 240 in FIG. 5, the pulp slurry deposited on the fourth layer forming mold 138 may be vacuum dehydrated, thereby forming a wet formed fourth layer 330.

Figure 13A:
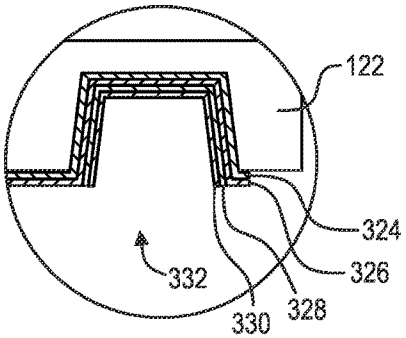
FIG. 13A is a magnified view of detail 13A in FIG. 13.

Referring to step 242 in FIG. 5 and the composite pulp forming machine 102 in FIG. 13, the transfer mold 122 with the wet formed first layer 324, wet formed second layer 326 and wet formed third layer 328 may be lowered into engagement with the fourth layer forming mold 138. Suction may be applied to transfer the wet formed fourth layer 330 to the transfer mold 122 with the wet formed first layer 324, the wet formed second layer 326 and the wet formed third layer 328 remaining disposed between the transfer mold 122 and the wet formed fourth layer 330. Referring to step 244 in FIG. 5, transfer mold 122 may be raised out of engagement with the fourth layer forming mold 138, with the transfer mold 122 retaining a wet formed multi-layer composite pulp tray 332 collectively defined by the wet formed first layer 324, the wet formed second layer 326, the wet formed third layer 328 and the wet formed fourth layer 330 (see, e.g., FIG. 13A).

Referring to step 246 in FIG. 5 and the composite pulp forming machine 102 in FIG. 14A, the transfer mold 122 may be laterally transported (e.g., in forward direction 404) with the wet formed multi-layer composite pulp tray 332 from the second forming station 114 to the release station 116.

Referring to step 204 in FIG. 5 and the system 100 in FIG. 14A, a drying line 104 may be provided. The inlet end 154 of the drying line 104 may be disposed below the release station 116 of the composite pulp forming machine 102.

Referring to step 248 in FIG. 5 and the system 100 in FIG. 14A, the wet formed multi-layer composite pulp tray 332 may be released from the transfer mold 122 onto the drying conveyor 158 at the inlet end 154 of the drying line 104. Referring to step 250 in FIG. 5, and the system 100 in FIGS. 4, 14A and 14B, the wet formed multi-layer composite pulp tray 332 may be conveyed through the drying box 160 of the drying line 104 by way of the drying conveyor 158, thereby converting the wet formed multi-layer composite pulp tray 332 to a semi-dry formed multi-layer composite pulp tray 334.

In particular preferred implementations of the system 100 and method 200, the wet formed multi-layer composite pulp tray 332 may have a moisture content. In certain such implementations, 60%-80% of the moisture content may be removed during the step of conveying (e.g., through the drying box 160), thereby resulting in the wet formed multi-layer composite pulp tray 332 being converted to the semi-dry formed multi-layer composite pulp tray 324. In particular preferred such implementations, 70% of the moisture content from the wet formed multi-layer composite pulp tray 332 may be removed during the step of conveying.

Referring to step 206 in FIG. 5 and the system 100 in FIGS. 4 and 14B, a drying and shaping machine 106 may be provided, for example at the outlet end 156 of the drying line 104. Referring to step 256 in FIG. 5 and the system 100 in FIG. 14B, after the step of conveying, the semi-dry formed multi-layer composite pulp tray 334 may be moved to a pre-press position (shown, e.g., at location B in FIG. 14B) above the lower shaping mold 164, and the semi-dry formed multi-layer composite pulp tray 334 may be released onto the lower shaping mold 164 (as shown, e.g., in FIG. 14B). Referring to step 258 in FIG. 5, the upper shaping mold 162 may be lowered (e.g., in downward direction 402) into engagement with the lower shaping mold 164 with the semi-dry formed multi-layer composite pulp tray 334 disposed therebetween. Referring to step 260 in FIG. 5, heat and pressure may be applied to the semi-dry formed multi-layer composite pulp tray 334 by way of mutual engagement between the upper shaping mold 162 and a lower shaping mold 164, thereby converting the semi-dry formed multi-layer composite pulp tray 334 into a multi-layer composite pulp tray 300 (i.e., the final product). Referring to step 262 in FIG. 5, the upper shaping mold 162 with the multi-layer composite pulp tray 300 affixed thereto may be raised (e.g., in upward direction 400) out of engagement with the lower shaping mold 164. The heat and pressure may preferably be applied to the semi-dry formed multi-layer composite pulp tray 334 by way of the upper shaping mold 162 and the lower shaping mold 164 for, for example, 1.5-2.5 minutes. The applied heat may preferably be at a set heating temperature of, for example, 150-200 degrees Celsius. This process may remove another approximately 20% of the moisture content of the corresponding wet formed multi-layer composite pulp tray 332 before it entered drying box 160, thereby leaving the multi-layer composite pulp tray 300 exiting the drying and shaping machine 106 with approximately 10% of the moisture content it had when it was a wet formed multi-layer composite pulp tray 332 exiting the composite pulp forming machine 102.

Referring to step 268 in FIG. 5 and the system 100 in FIGS. 4 and 14B, after the step of raising the upper shaping mold 162, the multi-layer composite pulp tray 300 may be deposited onto a tray rack 108 at a stacking location C.

Referring to step 252 in FIG. 5 and the system 100 in FIGS. 4 and 14B, after the step of conveying 250 and before the step of releasing the semi-dry formed multi-layer composite pulp tray 334 onto the lower shaping mold 164, movement of the semi-dry formed multi-layer composite pulp tray may be halted proximate the outlet end 156 of the drying line 104. Referring to step 254 in FIG. 5 and the system 100 in FIGS. 14B, 15 and 17A, with the angle iron frames 184 being in the tray guiding position, the semi-dry formed multi-layer composite pulp tray 334 may be pushed (e.g., by scraper 176 moving from the start position toward the end position) from the outlet end 156 into guided engagement with the angle iron frames 184 and into the pre-press position (shown, e.g., at B in FIG. 14B). The step of releasing the semi-dry formed multi-layer composite pulp tray 334 onto the lower shaping mold 164 may be by way of moving the angle iron frames 184 from the tray guiding position (e.g., as shown in FIG. 17A) toward the tray release position (e.g., as shown FIG. 17B).

Referring to steps 264-268 in FIG. 5 and the system 100 in FIG. 14B, after the step of raising the upper shaping mold 162 with the multi-layer composite pulp tray 300 affixed thereto, the angle iron frames 184 may be returned to the tray guiding position (e.g., as shown in FIG. 17A). The multi-layer composite pulp tray 300 may then be ejected from the upper shaping mold to fall back into guiding engagement with the angle iron frames 184 (see, e.g., FIG. 15). Referring to FIG. 14B, the step of depositing the multi-layer composite pulp tray 300 onto a tray rack 108 may be by way of movement of the scraper 176 toward the end position. For example, a multi-layer composite pulp tray 300 being pushed by the scraper 176 from location A into location B may cause a preceding multi-layer composite pulp tray 300 to be pushed from location B into stacking location C. Once the angle iron frames 184 are moved back to their release position (e.g., as shown on FIG. 17B), that multi-layer composite pulp tray 300 which was just pushed into stacking location C may be released to drop onto the tray stack 322 at location C.

Referring to FIGS. 6 and 7, in particular preferred implementations of the system 100 and method 200, the steps of rotating the first spindle 148 to place the first layer forming mold 126 downward and the step of rotating the second spindle 150 to place the third layer forming mold 134 downward are performed simultaneously with one another. Similarly, referring to FIGS. 7 and 8, in certain preferred implementations of the system 100 and method 200, the steps of flipping the first spindle to place the first layer forming mold 126 in an upward position and flipping the second spindle 150 to place the third layer forming mold 134 in an upward position are performed simultaneously with one another.

Referring to FIG. 4 and step 208 in FIG. 5, a robot transport vehicle 110 may be provided. Referring to step 270 in FIG. 5 and FIG. 14B, the tray rack 108 with a plurality of multi-layer composite pulp trays 300 stacked thereon may be lifted and transported to a designated storage location by way of the robotic transport vehicle 110 in accordance with instructions from a transport guidance program 111. The transport guidance program 111 may be remotely reconfigurable, for example to instruct the transport vehicle 110 to deliver tray stacks 322 to different sub-locations within a warehouse location in which the system 100 and method 200 are operating.

In particular implementations of the system 100 and method, each of the steps of vacuum dehydration may be performed for a dehydration time of, for example, 15-30 seconds.

Figure 2A:
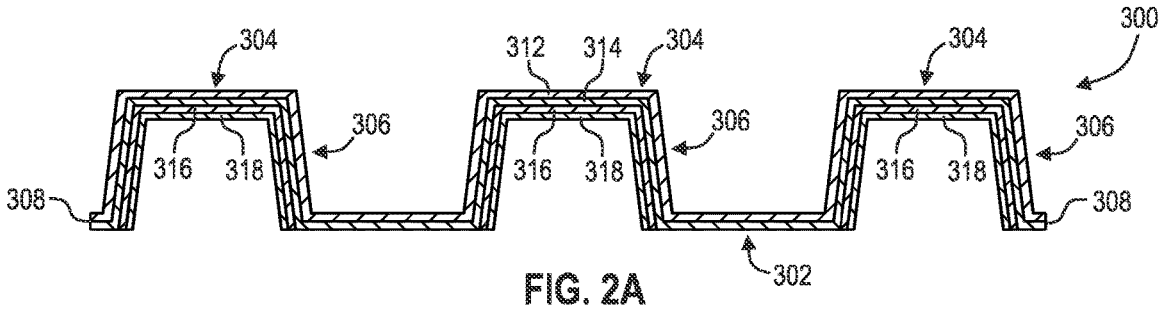
FIG. 2A is a diagrammatic cross-sectional view taken across lines 2-2 in FIG. 1, illustrating a tray product without any waterproof film layers.
Figure 2B:
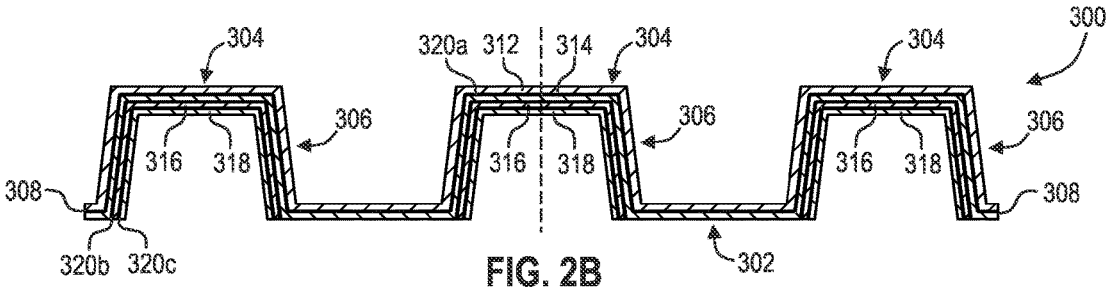
FIG. 2B is a diagrammatic cross-sectional view similar to that of FIG. 2A, but wherein the tray product includes waterproof film layers having been applied between respective pulp layers by the composite pulp forming machine during the tray manufacturing process.
Figure 3:
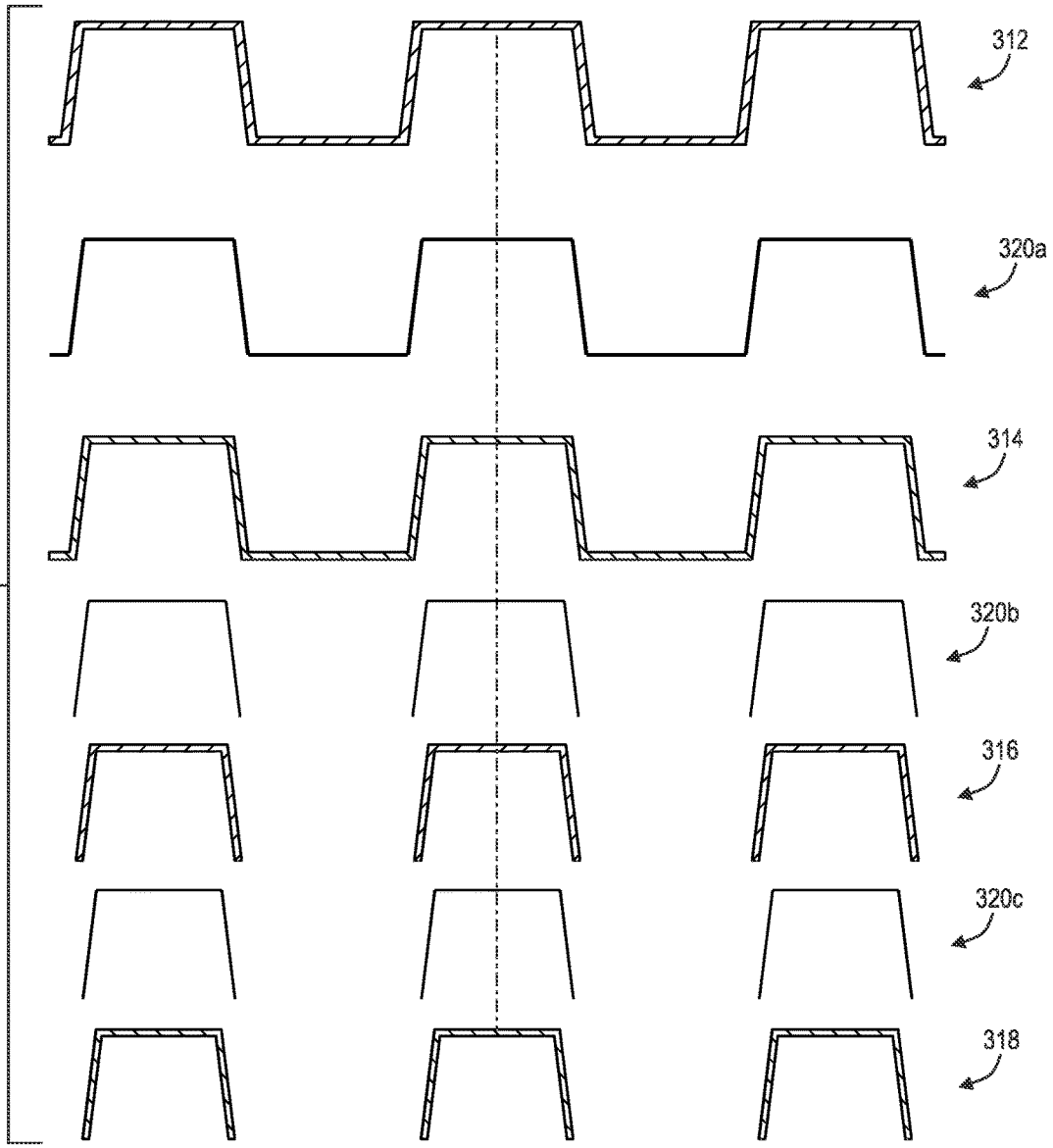
FIG. 3 is an exploded view of the cross-sectional view of FIG. 2B.
Figure 29:
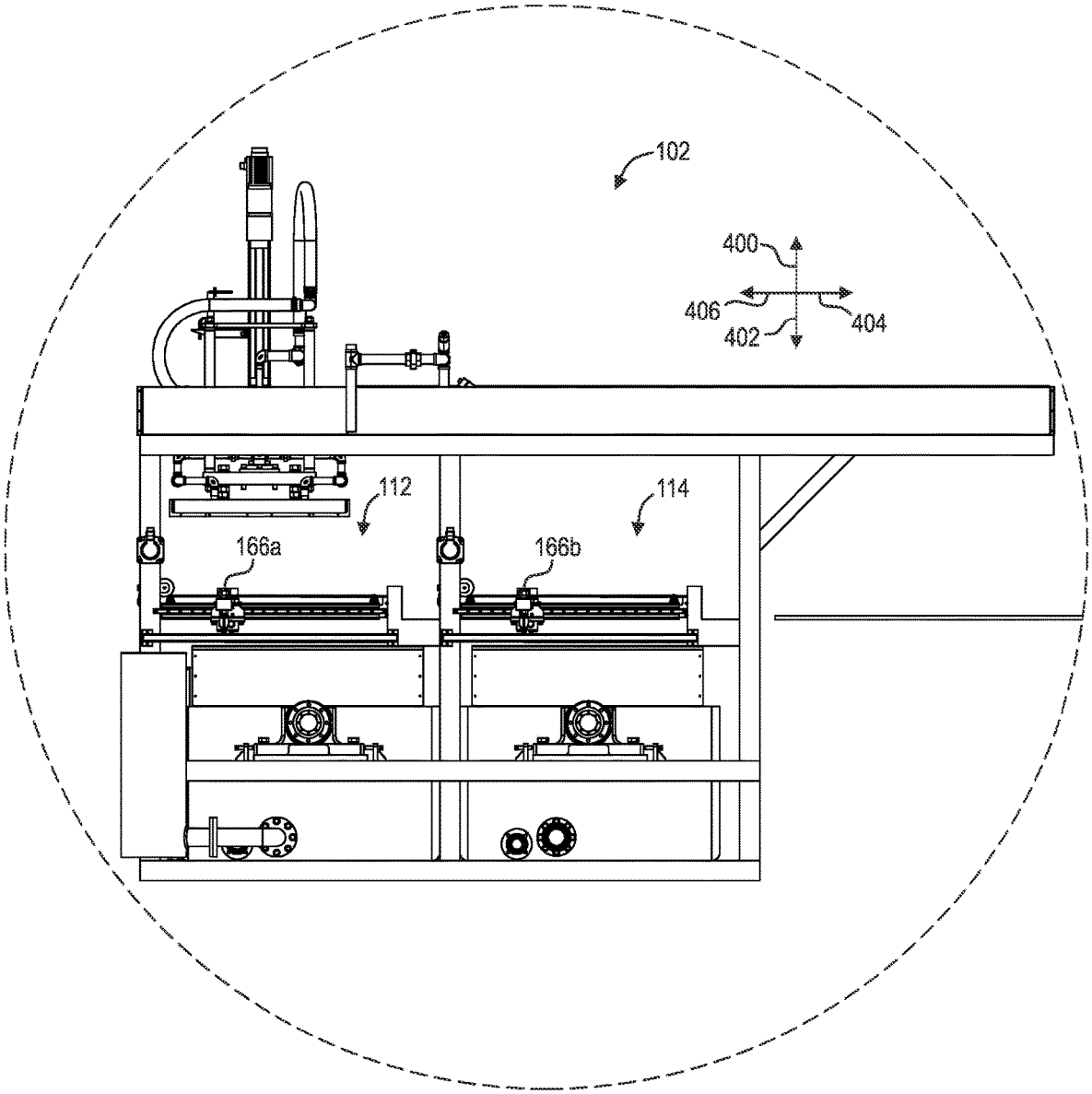
FIG. 29 is a magnified view of detail 29 in FIG. 26, showing a first spray bar in the first forming station and a second spray bar in the second forming station.
Figure 30:
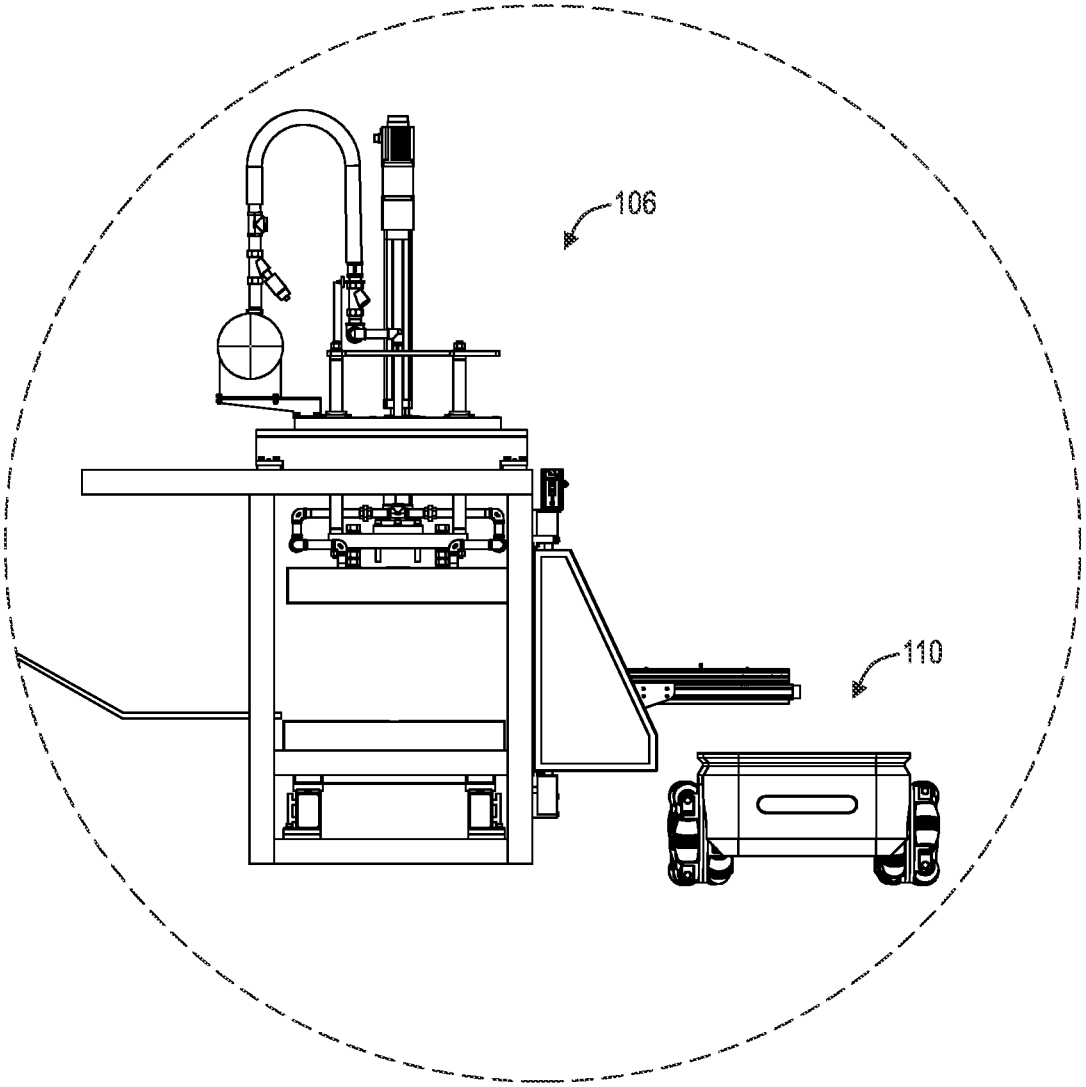
FIG. 30 is a magnified view of detail 30 in FIG. 26.

Referring to FIGS. 10 and 29, in certain implementations of the system 100 and method 200, the composite pulp forming machine 102 may comprise at least one spray bar 166, for example a first spray bar 166*a* and a second spray bar 166*b*. The spray bars (166, 166*b*) may be configured to spray waterproof film layers onto respective wet formed layers during the method of manufacturing 200. FIGS. 2B and 3 illustrate one example of a multi-layer composite pulp tray 300 with waterproof film layers (320*a*, 320*b*, 320*c*) resulting from a manufacturing method implementing one or more spray bars (166*a*, 166*b*).

In particular implementations of the system 100 and method 200, the one or more spray bars (166*a*, 166*b*) may each be disposed in switchable fluid communication (e.g., by way of one or more valves) with a supply of water and with a supply of waterproofing fluid. In such cases, the respective spray bars may first be used to spray water onto the wet formed layers (e.g., 324, 326, 328, 330) after their vacuum dehydration, but before they are picked up by the transfer mold 122 (e.g., to spray off fluffy edges resulting from residual pulp, thereby sharpening the edges of the wet formed layer). Separately, the spray bars (166, 166*b*) may be used to spray the water proofing fluid onto selected wet formed layers (e.g., 326, 328, 330), thereby forming respective waterproof film layers (e.g., 320*a*, 320*b*, 320*c*). The waterproofing fluid may be, for example, a water-based waterproof paint or the like.

Referring to FIG. 29, the one or more spray bars (166*a*, 166*b*) may preferably be laterally moveable, for example in a forward direction 404 and a rearward direction 406. A first spray bar 166*a* may be positioned at the first forming station 112. The second spray bar 166*b* may be positioned at the second forming station 114. In particular implementations of the system 100 and method 200, prior to the step of lowering the transfer mold 122 with the wet formed first layer 324 into engagement with the second layer forming mold 130 (see, e.g., FIG. 10), a first waterproof film layer 320*a* may be sprayed onto the wet formed second layer 326 by way of the first spray bar 166*a*. Similarly, in certain implementations of the system 100 and method 200, prior to the step of lowering the transfer mold 122 with the wet formed first layer 324 and wet formed second layer 326 into engagement with the third layer forming mold 134, a second waterproof film layer 320*b* may be sprayed onto the wet formed third layer 328 by way of the second spray bar 166*b*. Moreover, prior to the step of lowering the transfer mold 122 with the wet formed first layer 324, wet formed second layer 326 and wet formed third layer 328 into engagement with the fourth layer forming mold 138, a third waterproof film layer 320*c* may be sprayed onto the wet formed fourth layer 330 by way of the second spray bar 166*b*.

A variety of configurations of a multi-layer composite pulp tray 300 may be manufactured by way of the method 200 described herein.

The following listing matches certain terminology used within this disclosure with corresponding reference numbers used in the non-limiting examples illustrated in the several figures.

100 system for manufacturing a multi-layer composite pulp product
102 composite pulp forming machine
104 drying line (drying unit)
106 drying and shaping machine
108 product rack (e.g., bracket where stack of trays are deposited)
110 robotic transport vehicle
111 transport guidance program (e.g., remotely reconfigurable)
112 first forming station (within the composite pulp forming machine)
114 second forming station (within the composite pulp forming machine)
116 release station (of the composite pulp forming machine)
117 transfer mold subassembly
118 transfer cylinder
120 transfer template
122 transfer mold
124 first layer forming template
126 first layer forming mold
128 second layer forming template
130 second layer forming mold
132 third layer forming template (e.g., first column foot layer forming template)
134 third layer forming mold (e.g., first layer first column foot layer forming mold)
136 fourth later forming template (e.g., second column foot layer forming template)
138 fourth layer forming mold (e.g., second column foot layer forming mold)
140 lateral transfer motor
142 transfer rolling screw (e.g., lateral transfer jack screw)
144 first pulp slurry tank
146 second pulp slurry tank
147 pulp slurry (e.g., 1.2-1.5%, or 1.5-4% pulp concentration by volume)
148 first spindle
150 second spindle
152 forming machine framework
154 inlet end
156 outlet end
158 drying conveyor
160 drying box
162 upper shaping mold
164 lower shaping mold
166 spray bar (for spraying water and a water proof layer)
166*a* first spray bar (e.g., for spraying water and a waterproof layer)
166*b* second spray bar (e.g., for spraying water and a waterproof layer)
168 upper shaping template
170 lower shaping template
172 hydraulic station
174 oil cylinder
176 push plate (scraper) (moveable from a start position to an end position)
178 push slide motor
180 push tray slide screw
182 connecting motor
184 angle iron frames
186 locking screws
190 system controller
192 processor
194 memory
196 program code
198 user interface
200 method for manufacturing a multi-layer composite pulp product
300 multi-layer composite pulp tray
302 deck (of tray)
304 foot (of tray)
306 leg (of tray)
308 longitudinal edge (of tray)
310 lateral edge (of tray)
312 first pulp layer (of tray)
314 second pulp layer (of tray)
316 third pulp layer (of tray) (e.g., first column layer)
318 fourth pulp layer (of tray) (e.g., second column layer)
320*a* first waterproof film layer (e.g., water-based waterproof paint)

320*b* second waterproof film layer (e.g., water-based waterproof paint)
320*c* third waterproof film layer (e.g., water-based waterproof paint)
322 tray stack at location C
324 wet formed first layer
326 wet formed second layer
328 wet formed third layer (e.g., wet formed column foot first layer)
330 wet formed fourth layer (e.g., wet formed column foot second layer)
332 wet formed multi-layer composite pulp tray
334 semi-dry formed multi-layer composite pulp tray
336 pulp slurry deposited on first layer forming mold
338 pulp slurry deposited on second layer forming mold
340 pulp slurry deposited on third layer forming mold
342 pulp slurry deposited on fourth layer forming mold
400 upward direction
402 downward direction
404 forward direction
406 rearward direction While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of manufacturing a multi-layer composite pulp tray, the method comprising:

providing a composite pulp forming machine having a first forming station, a second forming station, a release station and a transfer mold subassembly, the first forming station having a first pulp slurry tank, a first spindle, a first layer forming mold, and a second layer forming mold, the second forming station having a second pulp slurry tank, a second spindle, a third layer forming mold, and a fourth layer forming mold, the first layer forming mold and the second layer forming mold being affixed to opposing sides of the first spindle, the third layer forming mold and the fourth layer forming mold being affixed to opposing sides of the second spindle, the transfer mold subassembly including a transfer mold, a transfer cylinder, a lateral transfer motor and a lateral transfer jack screw, the transfer mold be configured to be raised and lowered by the transfer cylinder;

injecting pulp slurry into the first pulp slurry tank and the second pulp slurry tank;

rotating the first spindle to place the first layer forming mold downward into the pulp slurry within the first pulp slurry tank, thereby depositing pulp slurry onto the first layer forming mold;

rotating the second spindle to place the third layer forming mold downward into the pulp slurry within the second pulp slurry tank, thereby depositing pulp slurry onto the third layer forming mold;

flipping the first spindle 180 rotational degrees to place the first layer forming mold in an upward position and to place the second layer forming mold downward into the pulp slurry within the first pulp slurry tank, thereby depositing pulp slurry onto the second layer forming mold;

vacuum dehydrating the pulp slurry deposited on the first layer forming mold, thereby forming a wet formed first layer;

lowering the transfer mold into engagement with the first layer forming mold, and applying suction to transfer the wet formed first layer to the transfer mold;

raising the transfer mold out of engagement with the first layer forming mold;

flipping the first spindle 180 rotational degrees to place the second layer forming mold in an upward position and returning the first layer forming mold downward into the pulp slurry within the first pulp slurry tank;

vacuum dehydrating the pulp slurry deposited on the second layer forming mold, thereby forming a wet formed second layer;

lowering the transfer mold with the wet formed first layer into engagement with the second layer forming mold, and applying suction to transfer the wet formed second layer to the transfer mold with the wet formed first layer remaining disposed between the transfer mold and the wet formed second layer;

raising the transfer mold out of engagement with the second layer forming mold, with the transfer mold retaining the wet formed first layer and the wet formed second layer;

laterally transporting the transfer mold from the first forming station to the second forming station, with the transfer mold retaining the wet formed first layer and the wet formed second layer;

flipping the second spindle 180 rotational degrees to place the third layer forming mold in an upward position and to place the fourth layer forming mold into the pulp slurry within the second pulp slurry tank, thereby depositing pulp slurry onto the fourth layer forming mold;

vacuum dehydrating the pulp slurry deposited on the third layer forming mold, thereby forming a wet formed third layer;

lowering the transfer mold with the wet formed first layer and wet formed second layer into engagement with the third layer forming mold, and applying suction to transfer the wet formed third layer to the transfer mold with the wet formed first layer and wet formed second layer remaining disposed between the transfer mold and the wet formed third layer;

flipping the second spindle 180 rotational degrees to place the fourth layer forming mold in an upward position and returning the third layer forming mold into the pulp slurry within the second pulp slurry tank;

vacuum dehydrating the pulp slurry deposited on the fourth layer forming mold, thereby forming a wet formed fourth layer;

lowering the transfer mold with the wet formed first layer, wet formed second layer and wet formed third layer into engagement with the fourth layer forming mold, and applying suction to transfer the wet formed fourth layer to the transfer mold with the wet formed first layer, the wet formed second layer and the wet formed third layer remaining disposed between the transfer mold and the wet formed fourth layer; and raising the transfer mold out of engagement with the fourth layer forming mold, with the transfer mold retaining a wet formed multi-layer composite pulp tray collectively defined by the wet formed first layer, the wet formed second layer, the wet formed third layer and the wet formed fourth layer.

2. The method of claim 1, further comprising:

laterally transporting the transfer mold with the wet formed multi-layer composite pulp tray from the second forming station to the release station;

providing a drying line having an inlet end and an outlet end, a drying conveyor conveyingly disposed between the inlet and the outlet end, and a drying box through which the drying conveyor extends;

releasing the wet formed multi-layer composite pulp tray from the transfer mold onto the drying conveyor at the inlet end of the drying line; and conveying the wet formed multi-layer composite pulp tray through the drying box by way of the drying conveyor, thereby converting the wet formed multi-layer composite pulp tray to a semi-dry formed multi-layer composite pulp tray.

3. The method of claim 2, wherein (a) the wet formed multi-layer composite pulp tray has a moisture content; and (b) up to 70% of the moisture content is removed during the step of conveying, thereby resulting in the wet formed multi-layer composite pulp tray being converted to the semi-dry formed multi-layer composite pulp tray.

4. The method of claim 2, further comprising:

providing a drying and shaping machine at the outlet end, the drying and shaping machine having an upper shaping mold and a lower shaping mold;

after the step of conveying, moving the semi-dry formed multi-layer composite pulp tray to a pre-press position above the lower shaping mold and releasing the semi-dry formed multi-layer composite pulp tray onto the lower shaping mold;

lowering the upper shaping mold into engagement with the lower shaping mold with the semi-dry formed multi-layer composite pulp tray disposed therebetween;

applying heat and pressure to the semi-dry formed multi-layer composite pulp tray by way of the upper shaping mold and a lower shaping mold, thereby converting the semi-dry formed multi-layer composite pulp tray into a multi-layer composite pulp tray; and raising the upper shaping mold with the multi-layer composite pulp tray affixed thereto.

5. The method of claim 4, wherein the heat and pressure are applied to the semi-dry formed multi-layer composite pulp tray by way of the upper shaping mold and the lower shaping mold for 1.5-2.5 minutes.

6. The method of claim 5, wherein the applied heat is at a set heating temperature of 150-200 degrees Celsius.

7. The method of claim 4, further comprising, after the step of raising the upper shaping mold:

depositing the multi-layer composite pulp tray onto a tray rack at a stacking location.

8. The method of claim 7, wherein the drying and shaping machine includes a pair of opposingly-disposed angle iron frames being movable by way of a reel motor toward one another into a tray guiding position, and away from one another into a tray release position.

9. The method of claim 8, further comprising, after the step of conveying and before the step of releasing the semi-dry formed multi-layer composite pulp tray onto the lower shaping mold:

halting movement of the semi-dry formed multi-layer composite pulp tray proximate the outlet end; and with the angle iron frames being in the tray guiding position, pushing the semi-dry formed multi-layer composite pulp tray from the outlet end into guided engagement with the angle iron frames and into the pre-press position;

wherein the step of releasing the semi-dry formed multi-layer composite pulp tray onto the lower shaping mold is by way of moving the angle iron frames from the tray guiding position toward the tray release position.

10. The method of claim 9, wherein the drying and shaping machine includes a scraper being moveable by a push slide motor between a start position and an end position; and the step of pushing is by way of movement of the scraper toward the end position.

11. The method of claim 10, further comprising, after the step of raising the upper shaping mold with the multi-layer composite pulp tray affixed thereto:

returning the angle iron frames to the tray guiding position; and ejecting the multi-layer composite pulp tray from the upper shaping mold and back into guiding engagement with the angle iron frames;

wherein the step of depositing the multi-layer composite pulp tray onto a tray rack is by way of movement of the scraper.

12. The method of claim 7, further comprising:

lifting and transporting the tray rack with a plurality of multi-layer composite pulp trays stacked thereon to a storage location by way of a robotic transport vehicle in accordance with instructions from a transport guidance program.

13. The method of claim 1, wherein (a) the steps of rotating the first spindle to place the first layer forming mold downward and the step of rotating the second spindle to place the third layer forming mold downward are performed simultaneously with one another; and (b) the steps of flipping the first spindle 180 rotational degrees to place the first layer forming mold in an upward position and flipping the second spindle 180 rotational degrees to place the third layer forming mold in an upward position are performed simultaneously with one another.

14. The method of claim 1, wherein the pulp slurry has a pulp concentration of 1.2% to 1.5% pulp.

15. The method of claim 1, wherein each of the steps of vacuum dehydration is performed for a dehydration time of 15-30 seconds.

16. The method of claim 1, further comprising, providing a first spray bar at the first forming station; and prior to the step of lowering the transfer mold with the wet formed first layer into engagement with the second layer forming mold, spraying a first waterproof film layer onto the wet formed second layer by way of the first spray bar.

17. The method of claim 16, further comprising, providing a second spray bar at the second forming station; and prior to the step of lowering the transfer mold with the wet formed first layer and wet formed second layer into engagement with the third layer forming mold, spraying a second waterproof film layer onto the wet formed third layer by way of the second spray bar.

18. The method of claim 17, further comprising, prior to the step of lowering the transfer mold with the wet formed first layer, wet formed second layer and wet formed third layer into engagement with the fourth layer forming mold, spraying a third waterproof film layer onto the wet formed fourth layer by way of the second spray bar.

19. A system for manufacturing a multi-layer composite pulp tray, the system comprising:

(a) a composite pulp forming machine having a first forming station, a second forming station, and a transfer mold subassembly, the first forming station having a first pulp slurry tank, a first spindle, a first layer forming mold, a second layer forming mold and a first spray bar, the second forming station having a second pulp slurry tank, a second spindle, a third layer forming mold, a fourth layer forming mold and a second spray bar, the first layer forming mold and the second layer forming mold being affixed to opposing sides of the first spindle, the third layer forming mold and the fourth layer forming mold being affixed to opposing sides of the second spindle, the transfer mold subassembly including a transfer mold, a transfer cylinder, a lateral transfer motor and a lateral transfer jack screw, the transfer mold be configured to be raised and lowered by the transfer cylinder;

(b) a drying line having an inlet end and an outlet end, a drying conveyor conveyingly disposed between the inlet and the outlet end, and a drying box through which the drying conveyor extends;

(c) a drying and shaping machine at the outlet end, the drying and shaping machine having (i) an upper shaping mold and a lower shaping mold; and (ii) a pair of opposingly-disposed angle iron frames being movable by way of a reel motor toward one another into a tray guiding position, and away from one another into a tray release position; and (d) a system controller having a processor and a memory, the memory storing program code which, when performed by the processor, causes performance of each of the steps of injecting, rotating, flipping, vacuum dehydrating, lowering, raising, laterally transporting and applying in the method of claim 1.

20. The system of claim 19, further comprising a tray rack at a stacking location; and a robotic transport vehicle being programmed with a transport guidance program, the transport guidance program being configured to cause the robotic transport vehicle to lift and transport the tray rack with a plurality of multi-layer composite pulp trays stacked thereon to a storage location by way of the transport guidance program.

* * * * *